US011073302B2

(12) United States Patent
Teraoka et al.

(10) Patent No.: US 11,073,302 B2
(45) Date of Patent: Jul. 27, 2021

(54) INDOOR UNIT OF AIR CONDITIONER

(71) Applicant: DAIKIN INDUSTRIES, LTD., Osaka (JP)

(72) Inventors: Hironobu Teraoka, Osaka (JP); Hideshi Tanaka, Osaka (JP); Satoshi Nakai, Osaka (JP); Masahito Higashida, Osaka (JP); Masafumi Uda, Osaka (JP); Kaname Maruyama, Osaka (JP); Zuozhou Chen, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/041,966

(22) PCT Filed: Feb. 26, 2019

(86) PCT No.: PCT/JP2019/007258
§ 371 (c)(1),
(2) Date: Sep. 25, 2020

(87) PCT Pub. No.: WO2019/187896
PCT Pub. Date: Oct. 3, 2019

(65) Prior Publication Data

US 2021/0048220 A1 Feb. 18, 2021

(30) Foreign Application Priority Data

Mar. 30, 2018 (JP) ..... JP2018-070196

(51) Int. Cl.
*F24F 13/20* (2006.01)
*F24F 1/0011* (2019.01)
(Continued)

(52) U.S. Cl.
CPC ..... *F24F 13/20* (2013.01); *F04D 17/04* (2013.01); *F04D 29/66* (2013.01); *F24F 1/0011* (2013.01); *F24F 1/0025* (2013.01); *F24F 1/0057* (2019.02)

(58) Field of Classification Search
CPC ..... F24F 1/0011; F24F 1/0025; F24F 1/0057; F24F 13/20
See application file for complete search history.

(56) References Cited

U.S. PATENT DOCUMENTS

2002/0172588 A1 11/2002 Ikeda et al.
2017/0276379 A1 9/2017 Ikeda et al.
2019/0383514 A1* 12/2019 Nanjappa ..... F24F 1/58

FOREIGN PATENT DOCUMENTS

CN 107120730 A 9/2017
EP 3282198 A1 * 2/2018 ..... F24F 1/0011
(Continued)

OTHER PUBLICATIONS

Extended European Search Report forApplication No. EP 19775655.4 dated Apr. 23, 2021.

*Primary Examiner* — Christopher R Zerphey
(74) *Attorney, Agent, or Firm* — Birch, Stewart, Kolasch & Birch, LLP

(57) ABSTRACT

This indoor unit of an air conditioner includes an indoor unit main body having an inlet and an outlet; a heat exchanger; and a cross-flow fan configured to blow out air, which has undergone heat exchange by the heat exchanger. The cross-flow fan has a blow-out flow path that is configured such that a cross-sectional area gradually increases downward, with the blow-out flow path guiding blown-out air to the outlet. When a distance in the lower wall from an intersection, where a tangent inscribing a tongue of the cross-flow fan orthogonally intersects the lower wall, to a lower end of the indoor unit main body is referred to as distance L, a ratio
(Continued)

(L/D) of the distance L to outer diameter D of an impeller of the cross-flow fan is less than 0.05. At least part of the blow-out flow path is formed to project out of the outlet at least when air conditioning operation is performed.

5 Claims, 15 Drawing Sheets

(51) Int. Cl.

| | |
|---|---|
| ***F24F 1/0025*** | (2019.01) |
| ***F24F 1/0057*** | (2019.01) |
| ***F04D 17/04*** | (2006.01) |
| ***F04D 29/66*** | (2006.01) |

(56) References Cited

FOREIGN PATENT DOCUMENTS

| | | | | | |
|---|---|---|---|---|---|
| FR | 3065791 | A1 | * | 11/2018 | ..... F24F 1/0011 |
| JP | H05-272799 | A | | 10/1993 | |
| JP | 2008/190813 | A | | 8/2008 | |
| JP | 2009-121731 | A | | 6/2009 | |
| JP | 4947227 | B1 | | 6/2012 | |
| JP | 2014-6044 | A | | 1/2014 | |
| JP | 2014-70811 | A | | 4/2014 | |
| JP | 2015-55419 | A | | 3/2015 | |
| JP | 2016-38151 | A | | 3/2016 | |
| JP | 2017-067404 | A | | 4/2017 | |
| WO | WO 2014/199590 | A1 | | 12/2014 | |
| WO | WO 2016/067408 | A1 | | 5/2016 | |

* cited by examiner

INDOOR UNIT OF AIR CONDITIONER

TECHNICAL FIELD

The present disclosure relates to an indoor unit of an air conditioner.

BACKGROUND ART

Patent Document 1 describes an example of an impeller and a cross-flow fan that has a blow-out flow path which guides blown-out-air from the impeller to an outlet.

PRIOR ART DOCUMENT

Patent Document

Patent Document 1: Japanese Laid-Open Patent Publication No. 2009-121731

SUMMARY OF THE INVENTION

Problems that the Invention is to Solve

There is a need for increasing the outer diameter of the impeller of the cross-flow fan to lower power consumption and reduce noise. However, increasing the height dimension of the indoor unit main body is not preferred since this would hinder installation of the indoor unit. Accordingly, if the outer diameter of the impeller is increased without increasing the height dimension of the indoor unit main body, the region that forms the blow-out flow path of the cross-flow fan would be decreased. This may adversely affect the performance of the indoor unit.

One objective of the present disclosure is to provide an indoor unit of an air conditioner that limits decreases in the performance of the indoor unit.

Means for Solving the Problems

An indoor unit of an air conditioner that solves the above problems includes an indoor unit main body, a heat exchanger, and a cross-flow fan. The indoor unit main body includes an inlet and an outlet. The heat exchanger performs heat exchange on air drawn in from the inlet. The cross-flow fan is configured to blow out air, which has undergone heat exchange performed by the heat exchanger, from the outlet. The cross-flow fan includes a blow-out flow path formed by a lower wall, left and right side walls, and an upper wall so that a cross-sectional area gradually increases downward. The blow-out flow path guides blown-out air to the outlet. When a distance in the lower wall from an intersection, where a tangent inscribing a tongue of the cross-flow fan orthogonally intersects the lower wall, to a lower end of the indoor unit main body is referred to as distance L, a ratio (L/D) of the distance L to outer diameter D of an impeller of the cross-flow fan is less than 0.05. At least part of the blow-out flow path is formed to project out of the outlet at least when an air conditioning operation is performed.

This structure limits decreases in the ease of installation of the indoor unit main body and allows power consumption and noise to be reduced by increasing the outer diameter D of the impeller of the cross-flow fan. Also, at least part of the blow-out flow path projects out of the outlet so that the diffuser has a sufficient length. This maintains the functionality of the diffuser. Consequently, adverse effects on the performance of the indoor unit will be limited.

In the above-described indoor unit of an air conditioner, it is preferred that the two side walls be arranged to project out of the outlet at least when an air conditioning operation is performed.

With this structure, the side walls restrict the air blown out of the outlet from flowing sideward from the outlet. This allows the blow-out flow path to be extended from the outlet. In this manner, the static pressure in the blow-out flow path is increased to increase the air volume of the blow-out flow path is increased. Further, when the air flow resistance (internal pressure loss) in the indoor unit main body is high, backflow of air from the two sideward ends of the outlet is restricted. Thus, surging is unlikely to occur.

In the above-described indoor unit of an air conditioner, it is preferred that the lower wall be arranged to project out of the outlet at least when an air conditioning operation is performed.

With this structure, the lower wall restricts the air blown out of the outlet from flowing downward from the outlet. This allows the blow-out flow path to be extended from the outlet. In this manner, the blow-out flow path serving as a diffuser is lengthened compared to a structure that does not project the upper wall out of the outlet. This further increases the static pressure in the blow-out flow path and further increases the air volume of the blow-out flow path. Also, when the air flow resistance (internal pressure loss) in the indoor unit main body is high, backflow of air from the lower part of the outlet is restricted. Thus, surging is even less likely to occur.

In the above-described indoor unit of an air conditioner, it is preferred that the upper wall be arranged to project out of the outlet at least when an air conditioning operation is performed.

With this structure, the upper wall restricts the air blown out of the outlet from flowing upward from the outlet. This allows the blow-out flow path to be extended from the outlet. In this manner, the blow-out flow path serving as a diffuser is lengthened compared to a structure that does not project the upper wall out of the outlet. This further increases the static pressure in the blow-out flow path and further increases the air volume of the blow-out flow path. Also, when the air flow resistance (internal pressure loss) in the indoor unit main body is high, backflow of air from the lower part of the outlet is restricted. Thus, surging is even less likely to occur.

In the above-described indoor unit of an air conditioner, it is preferred that a ratio (H/D) of height H of the indoor unit main body to the outer diameter D of the impeller of the cross-flow fan be less than 2.2.

With this structure, the indoor unit main body uses the cross-flow fan including the impeller with a relatively large outer diameter. This allows noise and power consumption to be reduced when an air conditioning operation is performed.

In the above-described indoor unit of an air conditioner, it is preferred that the indoor unit further include a movement mechanism configured to switch between a stored state that does not project an element forming the blow-out flow path out of the outlet and a projected state that projects at least part of the element out of the outlet. Preferably, the movement mechanism is in the projected state when an air conditioning operation is performed and in the stored state when an air conditioning operation is stopped.

With this structure, the blow-out flow path projects out of the indoor unit main body when an air conditioning operation is performed. Thus, surging is unlikely to occur. Further, the blow-out flow path is stored in the indoor unit main body when an air conditioning operation is stopped. Thus, the aesthetic appearance of the indoor unit is improved.

BRIEF DESCRIPTION OF THE DRAWINGS

FIG. 1 shows diagrams of an indoor unit of an air conditioner in accordance with a first embodiment, in which

FIG. 2 shows diagrams of the indoor unit in FIG. 1, in which

FIG. 5 shows diagrams of an indoor unit of an air conditioner in accordance with a second embodiment, in which

FIG. 6 shows diagrams of the indoor unit in FIG. 5, in which

FIG. 7 shows diagrams of an indoor unit of an air conditioner in accordance with a third embodiment, in which

FIG. 8 shows diagrams of the indoor unit in FIG. 7, in which

FIG. 9 shows diagrams of an indoor unit of an air conditioner in accordance with a fourth embodiment, in which

FIG. 10 shows diagrams of an indoor unit of an air conditioner of a modified example, in which

FIG. 11 shows diagrams of an indoor unit of an air conditioner of a modified example, in which

FIG. 12 shows diagrams of an indoor unit of an air conditioner of a modified example, in which

FIG. 13 shows diagrams of an indoor unit of an air conditioner of a modified example, in which

FIG. 14 shows diagrams of an indoor unit of an air conditioner of a modified example, in which

FIG. 15 shows diagrams of an indoor unit of an air conditioner of a modified example, in which

MODES FOR CARRYING OUT THE INVENTION

First Embodiment

Figure 4:
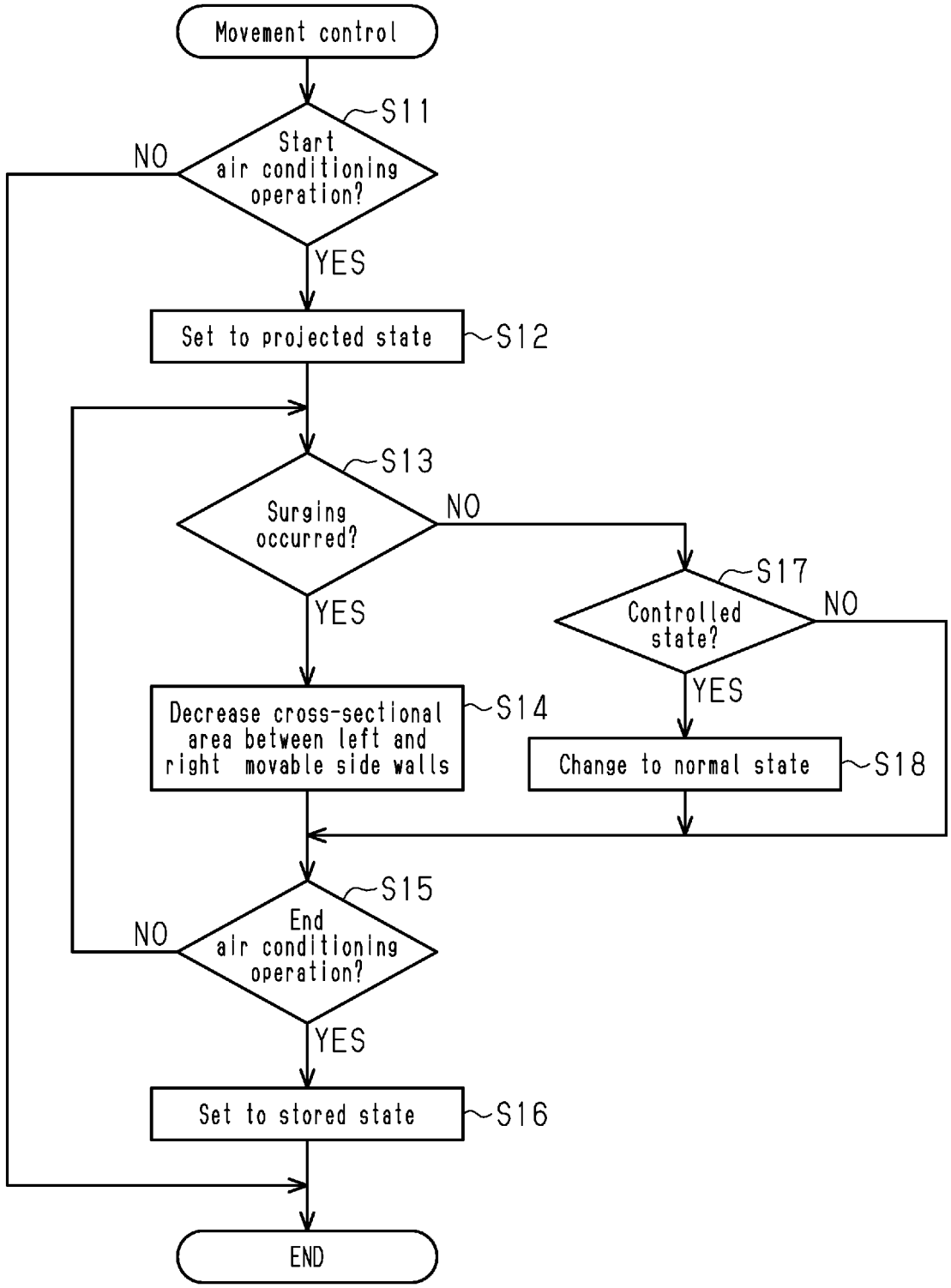
FIG. 4 is a flowchart illustrating one example of a procedure for processing movement control executed by a control unit of the indoor unit.

An indoor unit 1 of an air conditioner in accordance with a first embodiment will now be described with reference to FIGS. 1 and 4.

The indoor unit 1 of the present embodiment is of a wall-mounted type and includes a rear portion attached to an indoor wall WL. The indoor unit 1 is, for example, configured to perform a cooling operation that cools an indoor space and a heating operation that heats an indoor space.

As shown in FIGS. 1 and 2, the indoor unit 1 includes an indoor unit main body 10. The indoor unit main body 10 has the form of a box, in which a lateral direction (sideward direction of indoor unit 1) coincides with the longitudinal direction, and includes an inner space surrounded by a top surface portion 11, a front surface portion 12, a rear surface portion 13, two side surface portions 14, and a bottom surface portion 15. The indoor unit 1 is mounted on the wall WL by coupling the rear surface portion 13 to a mounting panel (not shown) on the wall WL with screws or the like. The top surface portion 11 of the indoor unit main body 10 includes an inlet 16, and the bottom surface portion 15 includes an outlet 17. The inlet 16 and the outlet 17 are each arranged so that the lateral direction (sideward direction) coincides with the longitudinal direction. The inlet 16 is formed along the top surface portion 11. The outlet 17 is formed along the bottom surface portion 15.

As shown in FIG. 2, the indoor unit 1 includes an air filter 21, an indoor heat exchanger 22, a cross-flow fan 23, and a flap 24. The air filter 21, the indoor heat exchanger 22, and the cross-flow fan 23 are accommodated in the indoor unit main body 10.

The air filter 21 is coupled to the indoor unit main body 10 in a removable manner. The air filter 21 removes dust from indoor air drawn in from the inlet 16. In a state in which the air filter 21 is attached to the indoor unit main body 10, the air filter 21 is located between the top surface portion 11 and the indoor heat exchanger 22 of the indoor unit main body 10. In this manner, the air filter 21 limits the collection of dust, which is suspended in the indoor air, on the surface of the indoor heat exchanger 22.

The indoor heat exchanger 22 includes a plurality of fins and a plurality of heat transfer tubes that extend through the fins. The indoor heat exchanger 22 serves as an evaporator or a condenser in accordance with an operation state of the indoor unit 1 and exchanges heat between a refrigerant flowing through the heat transfer tubes and air flowing through the indoor heat exchanger 22.

The indoor heat exchanger 22 is arranged so that its front end and rear end are bent downward in a side view. The indoor heat exchanger 22 is arranged to surround the cross-flow fan 23 from above.

The cross-flow fan 23 is located inside the indoor unit main body 10 at a substantially central portion. The cross-flow fan 23 includes an impeller 25 and a fan case 27. The impeller 25 is substantially cylindrical and has a lateral direction (sideward direction) that coincides with the longitudinal direction. The fan case 27 forms a blow-out flow path 26 that extends to the outlet 17. The blow-out flow path 26 is formed by a lower wall 26L, left and right side walls 26S, and an upper wall 26U in a manner so that its cross-sectional area gradually increases downward. In other words, the cross-sectional area of the blow-out flow path 26 increases toward the outlet 17. In this manner, the blow-out flow path 26 functions as a diffuser.

When the cross-flow fan 23 is being rotated and operated, the indoor air drawn in from the inlet 16 flows through the indoor heat exchanger 22 to the cross-flow fan 23. Then, the indoor air flows from the cross-flow fan 23 through the blow-out flow path 26 and is blown out of the outlet 17 into the room.

The impeller 25 of the cross-flow fan 23 has an outer diameter D, and the rear surface portion 13 of the indoor unit main body 10 has a vertical dimension (up-down dimension) that corresponds to a height H of the indoor unit main body 10. Preferably, the outer diameter D is 126 mm or greater and less than 150 mm. Further preferably, the outer diameter D is 135 mm or greater and less than 150 mm. Preferably, the height H of the indoor unit main body 10 is 295 mm or less. Further preferably, the height H of the indoor unit main body 10 is 250 mm or greater and 295 mm or less. Preferably, a ratio (H/D) of the height H of the indoor unit main body 10 to the outer diameter D is less than 2.2. Further preferably, the ratio (H/D) of the height H of the indoor unit main body 10 to the outer diameter D is 1.6 or greater and less than 2.2.

The flap 24 is arranged at a lower edge of the outlet 17 and is pivotal relative to the indoor unit main body 10. The flap 24 has the form of a flat plate and its lateral direction (sideward direction) coincides with the longitudinal direction. The flap 24 has a length in the longitudinal direction that is substantially the same as that of the outlet 17. The flap 24 is configured to be pivoted by a flap driving motor 28 (refer to FIG. 3) about a rotation axis C1.

The indoor unit 1 of the present embodiment includes a movement mechanism 29 that is configured to move the two side walls 26S of the blow-out flow path 26. More specifically, the two side walls 26S each include a fixed side wall 26SF and a movable side wall 26SM. The fixed side wall SF and the movable side wall 26SM are arranged to be overlapped with each other in the lateral direction (sideward direction). The movable side wall 26SM is configured to be movable so as to slide relative to the fixed side wall SF and project out of the outlet 17. The movement mechanism 29 moves the movable side walls 26SM. The movement mechanism 29 includes a first motor (not shown), which serves a drive source, and a rotation-linear movement conversion mechanism (not shown), which converts rotation of the first motor into linear movement in a predetermined direction. One example of the movement mechanism 29 is a feed-screw mechanism. Further, in a state in which the movable side walls 26SM project out of the outlet 17, the movement mechanism 29 is configured to move the movable side walls 26SM so as to decrease the cross-sectional area between the left and right movable side walls 26SM. In one example, the movement mechanism 29 includes a second motor (not shown) that pivots each movable side wall 26SM about a rotation axis C2 (refer to FIG. 2B). This allows the distance between the left and right movable side walls 26SM in the sideward direction to be changed at a projected end side. In this manner, the movement mechanism 29 allows for switching between a restricted state, in which the cross-sectional area between the left and right movable side walls 26SM is decreased, and a normal state, in which the cross-sectional area between the left and right movable side walls 26SM is not decreased. In one example, in the restricted state, the distance between the left and right movable side walls 26SM in the sideward direction at the projected end side is less than the sideward length of the outlet 17.

Figure 3:
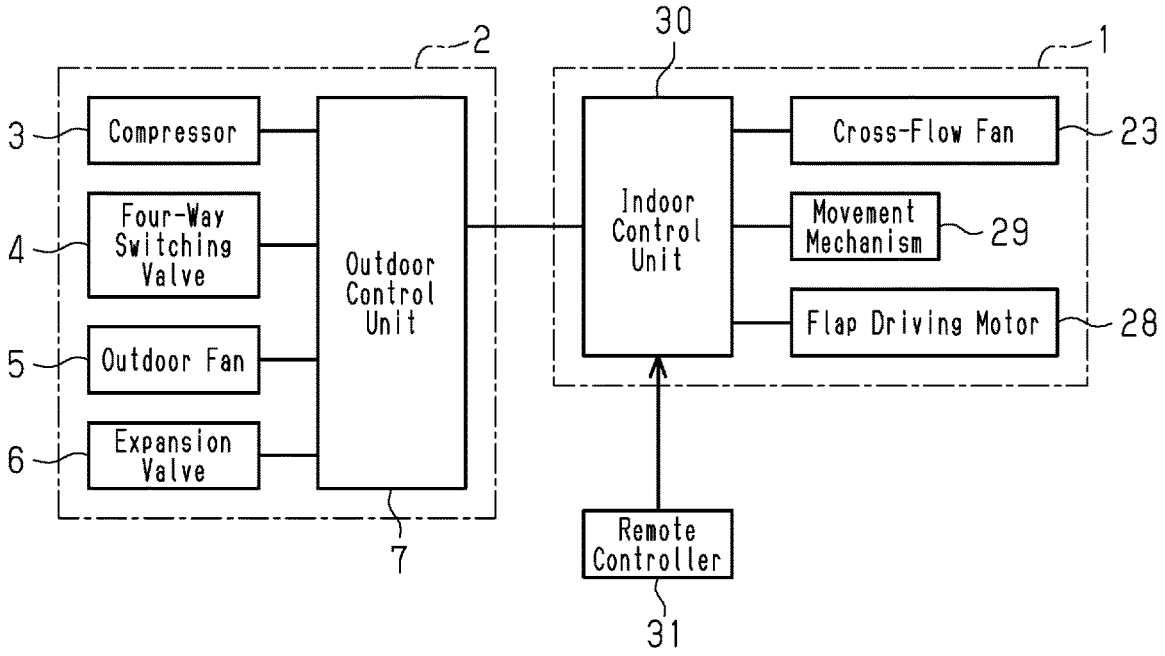
FIG. 3 is a block diagram showing the electrical structure of the air conditioner.

As shown in FIG. 3, the air conditioner includes an outdoor control unit 7 that controls each of a compressor 3 of an outdoor unit 2, a four-way switching valve 4, an outdoor fan 5, and an expansion valve 6. In one example, the outdoor control unit 7 controls the operational frequency (Hz) of the compressor 3, the rotational speed (rpm) of a motor of the outdoor fan 5, and the open degree of the expansion valve 6. Further, the outdoor control unit 7 switches the four-way switching valve 4 between a first state, in which a refrigerant circuit of the air conditioner (not shown) is in a cooling cycle, and a second state, in which the refrigerant circuit is in a heating cycle.

The indoor unit 1 includes an indoor control unit 30. The indoor control unit 30 includes a processor and storage. The processor executes predetermined control programs, and the storage stores information used for various types of control programs and control processes. The processor includes, for example, a central processing unit (CPU) or a micro-processing unit (MPU). The storage includes, for example, a nonvolatile memory and a volatile memory. The non-volatile memory includes, for example, a read-only memory (ROM), a hard disk, and a flash memory. The volatile memory includes, for example, a random-access memory (RAM). The indoor control unit 30 may include one or more micro-computers. The outdoor control unit 7 may be configured in the same manner as the indoor control unit 30.

The indoor control unit 30 is configured to establish wired or wireless communication with the outdoor control unit 7. Further, the indoor control unit 30 is configured to establish wireless communication with a remote controller 31. The indoor control unit 30 controls the cross-flow fan 23, the flap driving motor 28, and the movement mechanism 29 based on operation instructions from the remote controller 31. Further, the indoor control unit 30 transmits the contents of an operation instruction from the remote controller 31 to the outdoor control unit 7. Based on the operation instruction from the remote controller 31, the outdoor control unit 7 controls the operational frequency (Hz) of the compressor 3, the rotational speed (rpm) of the outdoor fan 5, the open degree of the expansion valve 6, and switching of the four-way switching valve 4 between the first state and the second state.

Figure 1A:
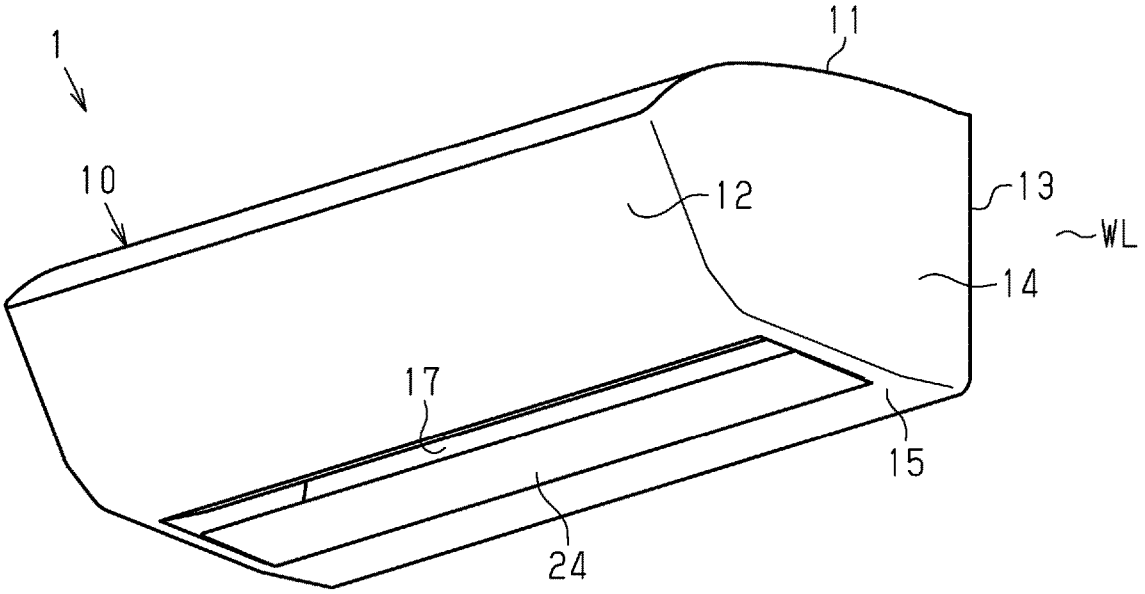
FIG. 1A is a perspective view of the indoor unit in a stored state.
Figure 1B:
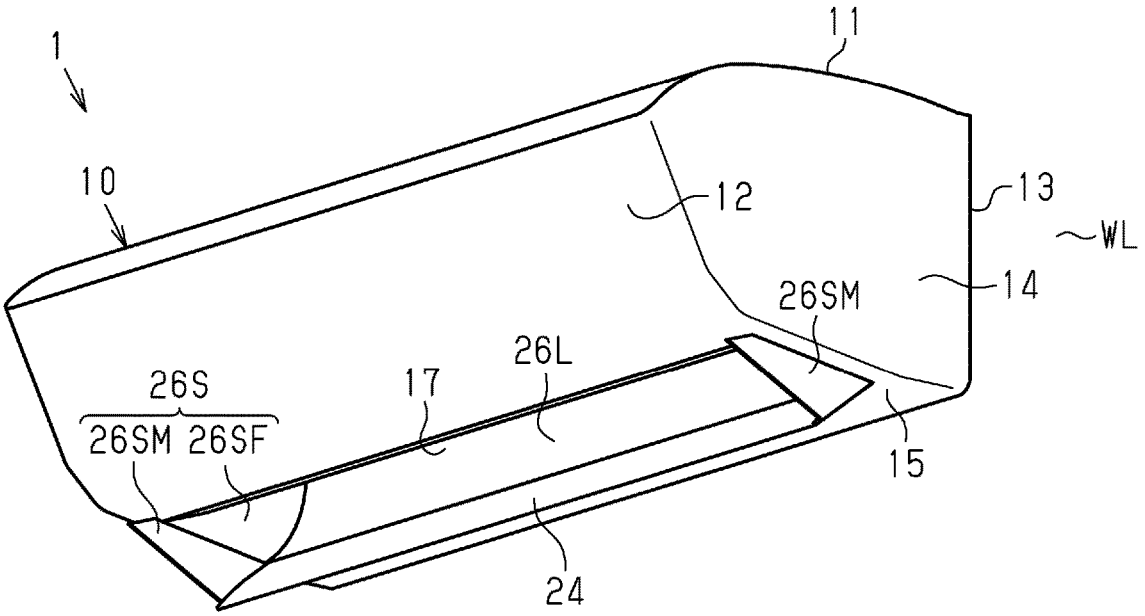
FIG. 1B is a perspective view of the indoor unit in a projected state.
Figure 2A:
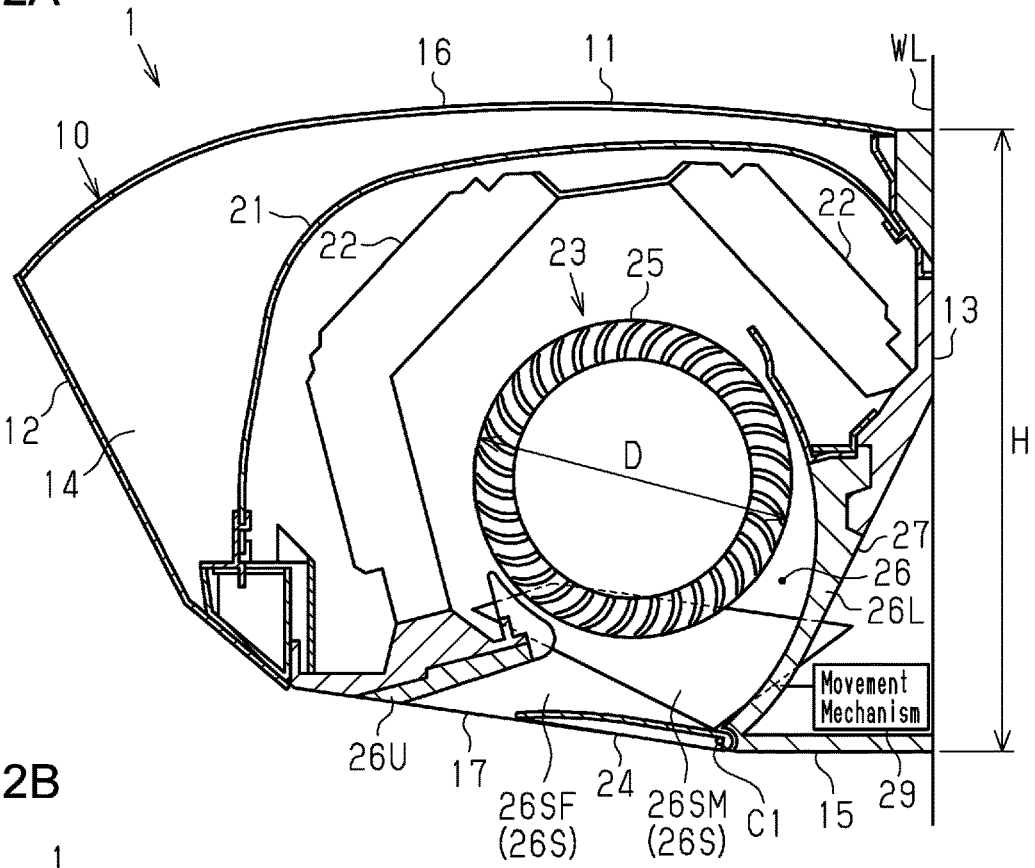
FIG. 2A is a cross-sectional view of the indoor unit in the stored state.
Figure 2B:
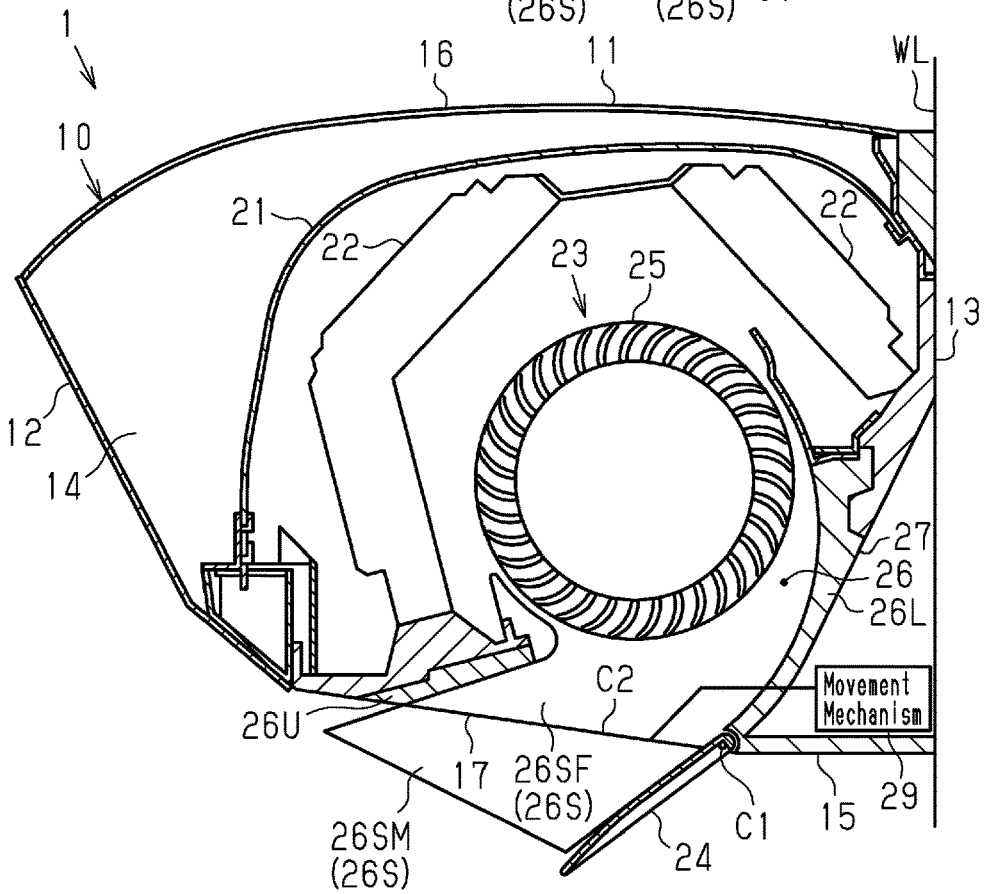
FIG. 2B is a cross-sectional view of the indoor unit in the projected state.

The indoor control unit 30 of the present embodiment controls the movement mechanism 29 to switch between the stored state, in which the movable side walls 26SM do not project out of the outlet 17 as shown in FIGS. 1A and 2A, and the projected state, in which the movable side walls 26SM project out of the outlet 17 as shown in FIGS. 1B and 2B. In one example, the indoor control unit 30 controls the movement mechanism 29 to be in the projected state when an air conditioning operation is performed and controls the movement mechanism 29 to be in the stored state when an air conditioning operation is stopped. In one example, as shown in FIGS. 1B and 2B, in the projected state, the movable side walls 26SM are configured to entirely cover transverse sides (up-down sides) of the outlet 17 in the projected state.

Also, when an air conditioning operation is stopped, the indoor control unit 30 controls the flap driving motor 28 so that the flap 24 covers the outlet 17 as shown in FIGS. 1A and 2A. Further, when an air conditioning operation is performed, the indoor control unit 30 controls the flap driving motor 28 so that the flap 24 opens the outlet 17 as shown in FIGS. 1B and 2B. In this manner, when an air conditioning operation is stopped, the indoor unit 1 shown in FIGS. 1A and 2A is in a state in which the movable side walls 26SM and the flap 24 do not project out of the indoor unit main body 10. Further, when an air conditioning operation is performed, the indoor unit 1 shown in FIGS. 1B and 2B is in a state in which the movable side walls 26SM and the flap 24 project out of the indoor unit main body 10.

When an air conditioning operation is performed, the pivotal position of the flap 24 can be freely changed. In one example, the pivotal position of the flap 24 is changeable by an instruction from the remote controller 31.

Further, when surging occurs, the indoor control unit 30 controls the movement mechanism 29 in the restricted state to decrease the cross-sectional area between the left and right movable side walls 26SM with the second motor that pivots each movable side wall 26SM about the rotation axis C2 (refer to FIG. 2B). In the restricted state, the cross-sectional area of the blow-out flow path 26 at a downstream side of the outlet 17 is smaller than the cross-sectional area of the outlet 17. This increases the velocity of the indoor air in the blow-out flow path 26 and impedes surging. Further, when surging is impeded, the indoor control unit 30 controls the movement mechanism 29 to switch from the restricted state to the normal state with the second motor. Here, surging refers to noise (for example, rustling noise) produced when the volume or pressure of the indoor air blown out of the outlet 17 becomes unstable and backflow forms at the outlet 17. Surging is likely to occur, for example, when the air filter 21 is clogged with dust and the air flow resistance is increased or when condensation is formed on the indoor heat exchanger 22.

In one example, surging is detected from the rotational speed (rpm) of a fan motor (not shown) of the cross-flow fan 23. More specifically, the indoor control unit 30 sets the rotational speed of the fan motor in accordance with the operation instruction from the remote controller 31. The rotational speed of the fan motor that is set will be referred to as the set rotational speed. The indoor control unit 30 determines whether the rotational speed of the fan motor is in a tolerable rotational speed range that has a predetermined width centered on the set rotational speed. When the rotational speed of the fan motor is in the tolerable rotational speed range, the rotational speed of the fan motor is stable and the volume and pressure of the indoor air are less likely to be unstable. Accordingly, the indoor control unit 30 determines that surging has not occurred. When the rotational speed of the motor is outside the tolerable rotational speed range, the rotational speed of the fan motor is unstable and the volume and pressure of the indoor air are likely to be unstable. Accordingly, the indoor control unit 30 determines that surging has occurred. In the above-described detection of surging, the predetermined width is used to determine whether surging has occurred due to variations in the rotational speed of the fan motor and is set in advance through tests or the like.

Alternatively, surging may be detected from the current supplied to the fan motor of the cross-flow fan 23. More specifically, the indoor control unit 30 determines whether the current supplied to the fan motor is in a tolerable current range that has a predetermined width centered on a current value corresponding to the set rotational speed. When the current supplied to the fan motor is in the tolerable current range, the volume and pressure of the indoor air are stable and the current supplied to the fan motor is stable. Accordingly, the indoor control unit 30 determines that surging has not occurred. When the current supplied to the fan motor is outside the tolerable current range, the volume and pressure of the indoor air are unstable and the current supplied to the fan motor is unstable. Accordingly, the indoor control unit 30 determines that surging has occurred. The predetermined width is used to determine whether surging has occurred due to variations in the current supplied to the fan motor and is set in advance through tests or the like.

One example of a processing procedure for a movement control of the movement mechanism 29 executed by the indoor control unit 30 will now be described with reference to FIG. 4. This movement control is executed over a period of time from when an air conditioning operation starts to when it ends.

In step S11, the indoor control unit 30 determines whether to start an air conditioning operation. In one example, when an operation start instruction has been received from the remote controller 31, the indoor control unit 30 determines to start an air conditioning operation. Further, when an operation start instruction has not been received, the indoor control unit 30 determines not to start an air conditioning operation.

When the indoor control unit 30 determines not to start an air conditioning operation (step S11: NO), the indoor control unit 30 ends the process. In this case, the movable side walls 26SM are maintained to be in the stored state. When the indoor control unit 30 determines to start an air conditioning operation (step S11: YES), the indoor control unit 30 sets the movable side walls 26SM in the projected state in step 12. This projects the movable side walls 26SM out of the outlet 17. Subsequently, in step S13, the indoor control unit 30 determines whether surging has occurred.

When determining that surging has occurred (step S13: YES), the indoor control unit 30 controls the second motor of the movement mechanism 29 to switch to the restricted state, in which the cross-sectional area between the left and right movable side walls 26SM is decreased, in step S14. Then, in step S15, the indoor control unit 30 determines whether to end the air conditioning operation. In one example, when an operation end instruction has been received from the remote controller 31, the indoor control unit 30 determines to end the air conditioning operation. Further, when an operation end instruction has not been received, the indoor control unit 30 determines not to end the air conditioning operation.

When the indoor control unit 30 determines not to end the air conditioning operation (step S15: NO), the indoor control unit 30 proceeds to step S13. When the indoor control unit 30 determines to end the air conditioning operation (step S15: YES), the indoor control unit 30 sets the movable side walls 26SM in the stored state in step S16. This stores the movable side walls 26SM in the indoor unit main body 10.

Further, when surging has not occurred (step S13: NO), the indoor control unit 30 determines whether the movable side walls 26SM are in the restricted state in step S17. When the movable side walls 26SM are in the restricted state (step S17: YES), the indoor control unit 30 changes the movable side walls 26SM to the normal state in step S18 and then proceeds to step S15. When the movable side walls 26SM are in the normal state (step S17: NO), the indoor control unit 30 maintains the movable side walls 26SM in the normal state and then proceeds to step S15.

The operation of the present embodiment will now be described.

If the outer diameter D of the impeller 25 of the cross-flow fan 23 is increased to lower power consumption and reduce noise without increasing the height H of the indoor unit main body 10 so as to limit decreases in the ease of installation of the indoor unit main body 10, the region that defines the blow-out flow path 26 of the cross-flow fan 23 in the indoor unit main body 10 would be decreased and the blow-out flow path 26 would be shortened. When the blow-out flow path 26 is shortened, the dynamic pressure of the indoor air will not be sufficiently converted into the static pressure in the blow-out flow path 26. This would decrease the air volume and pressure in the cross-flow fan 23.

Also, when the air flow resistance inside the indoor unit main body 10 is increased due to condensation on the indoor heat exchanger 22 or clogging of the air filter 21, the velocity of the indoor air in the blow-out flow path 26 will be decreased and backflow from the outlet 17 is likely to be generated. As a result, backflow of indoor air from the outlet 17 may cause surging that destabilizes the flow of the indoor air blown out of the cross-flow fan 23. Particularly, it is known that the velocity of indoor air at the two sideward ends of the outlet 17 is slower than that at a laterally central part of the outlet 17. Accordingly, backflow from the outlet 17 is more likely to be generated at the two sideward ends of the outlet 17.

In this respect, in the present embodiment, the movable side walls 26SM project out of the outlet 17 when an air conditioning operation is performed. This allows the blow-out flow path 26 to be extended by an amount corresponding to the length of the movable side walls 26SM. Furthermore, the movable side walls 26SM extend from the two sideward ends of the outlet 17 to project out of the outlet 17. This limits backflow of indoor air into the outlet 17 from an outer side of the two sideward ends of the outlet 17. Consequently, surging is impeded and changes in the air volume and pressure in the cross-flow fan 23 are limited.

The present embodiment has the following advantages.

(1-1) The movable side walls 26SM of the two side walls 26S are arranged to project out of the outlet 17 at least when an air conditioning operation is performed. With this structure, the movable side walls 26SM restrict the indoor air blown out of the outlet 17 from flowing sideward from the outlet 17. This allows the blow-out flow path 26 to be extended from the outlet 17. In this manner, the static pressure in the blow-out flow path 26 is increased to increase the air volume of the blow-out flow path 26. Further, when the air flow resistance (internal pressure loss) inside the indoor unit main body 10 is increased due to, for example, condensation on the indoor heat exchanger 22, clogging of the air filter 21, or the like, backflow of indoor air from the two ends of the outlet 17 is restricted. Thus, surging is unlikely to occur.

(1-2) When surging occurs, the movement mechanism 29 decreases the distance between the two movable side walls 26SM so that the distance is less than the sideward length of the outlet 17. With this structure, the cross-sectional area of the blow-out flow path 26 at a downstream side of the outlet 17 is decreased so that the velocity of indoor air in the blow-out flow path 26 at the downstream side of the outlet 17 is increased. This restricts backflow of indoor air from the outlet 17 and thereby impedes surging.

(1-3) The indoor unit 1 includes the movement mechanism 29 that switches to the projected state, in which the movable side walls 26SM project out of the outlet 17, when an air conditioning operation is performed and switches to the stored state, in which the movable side walls 26SM do not project out of the outlet 17, when an air conditioning operation is stopped. With this structure, the movable side walls 26SM project out of the indoor unit main body 10 when an air conditioning operation is performed. Thus, surging is unlikely to occur. Further, the movable side walls 26SM are stored in the indoor unit main body 10 when an air conditioning operation is stopped. Thus, the aesthetic appearance of the indoor unit 1 is improved.

(1-4) The indoor unit 1 is configured so that the ratio (H/D) of the height H of the indoor unit main body 10 to the outer diameter D of the impeller 25 of the cross-flow fan 23 is less than 2.2. With this structure, the indoor unit main body 10 uses the cross-flow fan 23 including the impeller 25 with a relatively large outer diameter D. This allows noise and power consumption to be reduced when the indoor unit 1 is operating.

(1-5) The indoor unit 1 is configured so that the ratio (H/D) of the height H of the indoor unit main body 10 to the outer diameter D of the impeller 25 of the cross-flow fan 23 is greater than or equal to 1.6 and less than 2.2. This structure limits decreases in the ease of setting of the indoor unit main body 10 in addition to obtaining advantage (1-4).

(1-6) The height H of the indoor unit main body 10 is less than or equal to 295 mm. This limits decreases in the ease of installation of the indoor unit main body 10. Particularly, the height H of the indoor unit main body 10 is greater than or equal to 250 mm and less than or equal to 295 mm. In this case, the cross-flow fan 23 including the impeller 25 that has a relatively large outer diameter D can be used. This allows power consumption and noise to be reduced while limiting decrease in the ease of setting of the indoor unit main body 10.

Second Embodiment

An indoor unit 1 of an air conditioner in accordance with a second embodiment will now be described with reference to FIGS. 5 and 6. The indoor unit 1 of the present embodiment differs from the indoor unit 1 of the first embodiment in that the lower wall 26L of the blow-out flow path 26 is projected out of the outlet 17 together with the two side walls 26S when an air conditioning operation is performed. In the description hereafter, same reference numerals are given to those elements that are the same as the indoor unit 1 of the first embodiment. Such elements will not be described in detail.

Figure 5A:
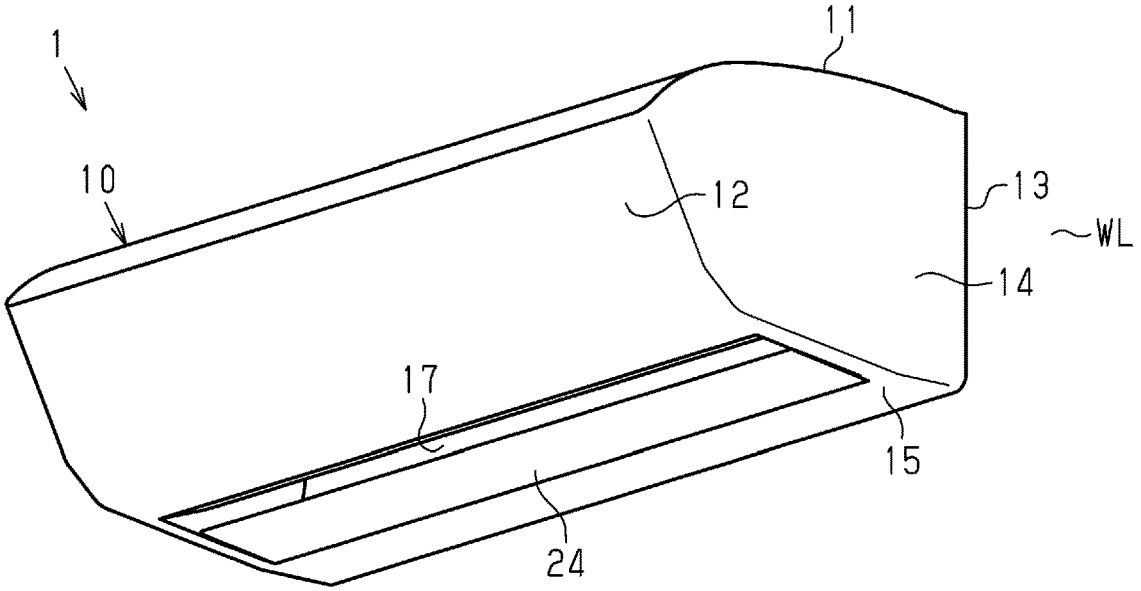
FIG. 5A is a perspective view of the indoor unit in a stored state.
Figure 5B:
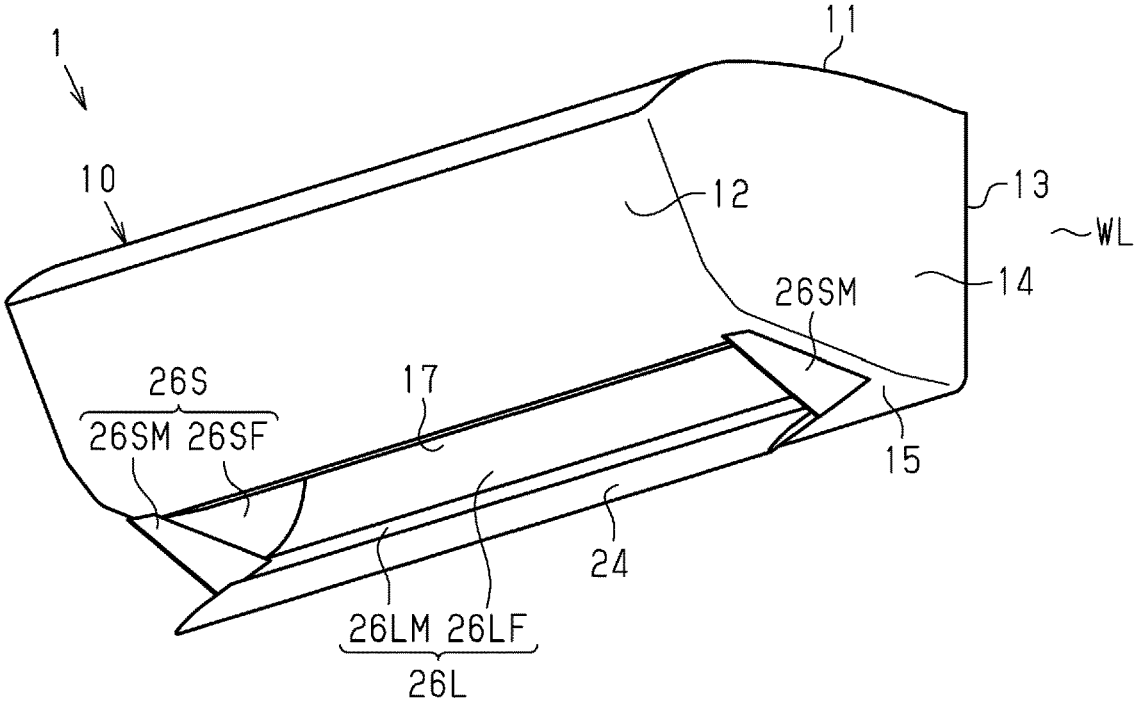
FIG. 5B is a perspective view of the indoor unit in a projected state.
Figure 6A:
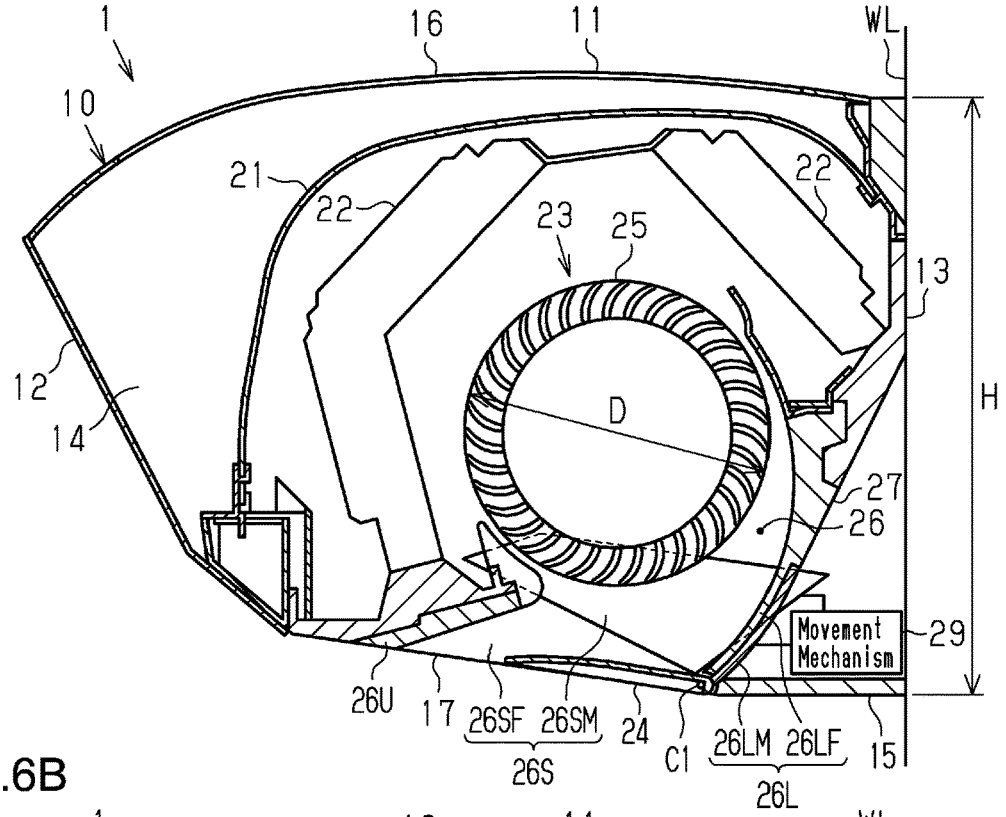
FIG. 6A is a cross-sectional view of the indoor unit in the stored state.
Figure 6B:
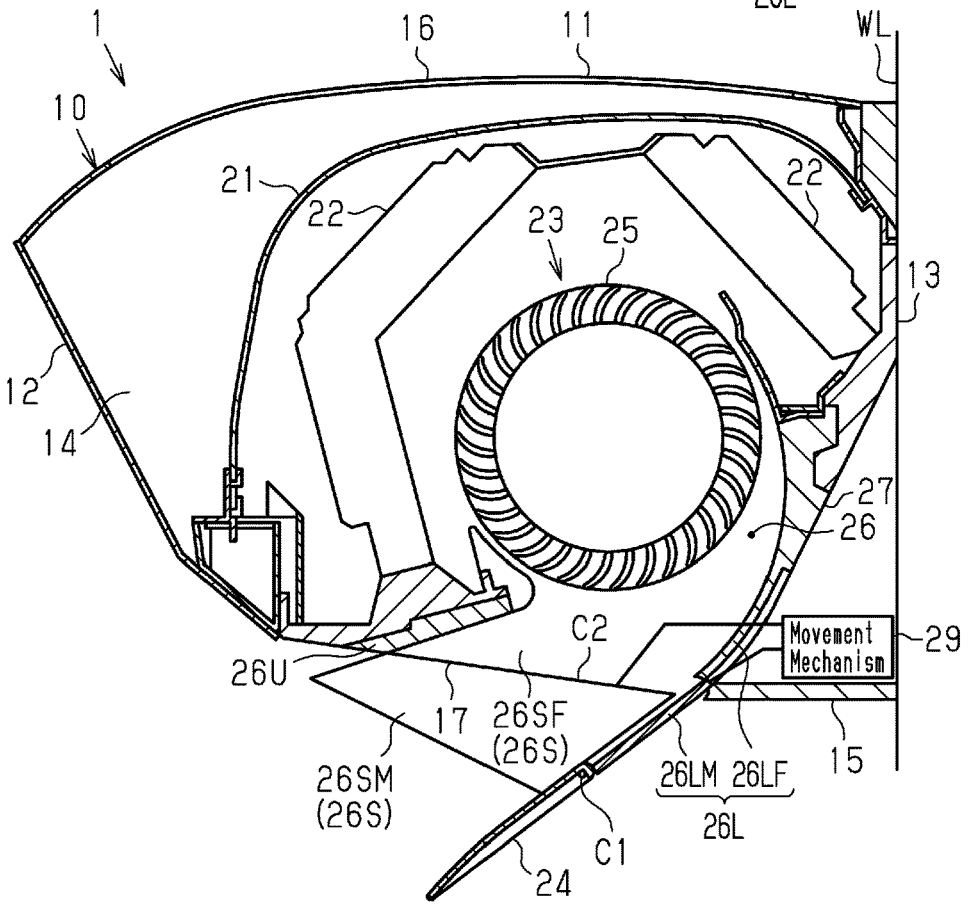
FIG. 6B is a cross-sectional view of the indoor unit in the projected state.

As shown in FIGS. 5B and 6B, the lower wall 26L includes a fixed lower wall 26LF and a movable lower wall 26LM. The flap 24 is coupled to a distal end of the movable lower wall 26LM and is pivotal relative to the movable lower wall 26LM. The fixed lower wall 26LF and the movable lower wall 26LM are overlapped with each other in the vertical direction (up-down direction). The movable lower wall 26LM is configured to be movable so as to slide relative to the fixed lower wall 26LF and project out of the outlet 17.

The movement mechanism 29 of the present embodiment is configured to move the movable side walls 26SM and the movable lower wall 26LM. In one example, the movement mechanism 29 is configured to move and slide the movable side walls 26SM relative to the fixed side walls SF and move and slide the movable lower wall 26LM relative to the fixed lower wall 26LF. The movement mechanism 29 includes a first motor, a first rotation-linear movement conversion mechanism that converts rotation of the first motor into linear movement of the movable side walls 26SM, and a second rotation-linear movement conversion mechanism that converts rotation of the first motor into linear movement of the movable lower wall 26LM. In other words, the movement mechanism 29 of the present embodiment moves the movable side walls 26SM and the movable lower wall 26LM with a single drive source.

The indoor control unit 30 of the present embodiment (refer to FIG. 3) controls the movement mechanism 29 to switch between a stored state, in which the movable side walls 26SM and the movable lower wall 26LM do not project out of the outlet 17 as shown in FIGS. 5A and 6A, and a projected state, in which the movable side walls 26SM and the movable lower wall 26LM project out of the outlet 17 as shown in FIGS. 5B and 6B. In one example, the indoor control unit 30 controls the movement mechanism 29 in the projected state when an air conditioning operation is performed and controls the movement mechanism 29 in the stored state when an air conditioning operation is stopped.

In the projected state, the movable side walls 26SM are located above the sideward ends of the movable lower wall 26LM. The movable side walls SM are arranged so that no gap is formed between the movable side walls 26SM and the movable lower wall 26LM in the vertical direction. Further, each movable side wall 26SM is pivotal about the rotation axis C2 between the upper wall 26U and the movable lower wall 26LM.

Also, the relationship of the outer diameter D of the impeller 25 of the cross-flow fan 23 and the height H of the indoor unit main body 10 of the present embodiment is the same as the relationship of the outer diameter D of the impeller 25 of the cross-flow fan 23 and the height H of the indoor unit main body 10 of the first embodiment.

The present embodiment has the following advantages in addition to the advantages of the first embodiment.

(2-1) The movable side walls 26SM of the two side walls 26S and the movable lower wall 26LM of the lower wall 26L are arranged to project out of the outlet 17 at least when an air conditioning operation is performed. With this structure, the movable side walls 26SM and the movable lower walls 26LM restrict the indoor air blown out of the outlet 17 from flowing sideward and downward from the outlet 17. This allows the blow-out flow path 26 to be extended from the outlet 17. In this manner, the blow-out flow path 26 serving as a diffuser is lengthened compared to a structure that does not project the two side walls 26S and the lower wall 26L out of the outlet 17. This further increases the static pressure in the blow-out flow path 26 and further increases the air volume of the blow-out flow path 26. Also, when the air flow resistance (internal pressure loss) in the indoor unit main body 10 is high, backflow of indoor air from the two sideward ends and the lower part of the outlet 17 is restricted. Thus, surging is even less likely to occur.

(2-2) The indoor unit 1 includes the movement mechanism 29 that projects the movable side walls 26SM and the movable lower wall 26LM out of the outlet 17 in the projected state when an air conditioning operation is performed and does not project the movable side walls 26SM and the movable lower wall 26LM out of the outlet 17 in the stored state when an air conditioning operation is stopped. With this structure, the movable side walls 26SM and the movable lower wall 26LM project out of the indoor unit main body 10 when an air conditioning operation is performed. Thus, surging is unlikely to occur. Further, the movable side walls 26SM and the movable lower wall 26LM are stored in the indoor unit main body 10. Thus, the aesthetic appearance of the indoor unit 1 is improved.

Third Embodiment

An indoor unit 1 of an air conditioner in accordance with a third embodiment will now be described with reference to FIGS. 7 and 8. The indoor unit 1 of the present embodiment differs from the indoor unit 1 of the second embodiment in that the upper wall 26U projects out of the outlet 17 together with the two side walls 26S and the lower wall 26L of the blow-out flow path 26 when an air conditioning operation is performed. In the description hereafter, same reference numerals are given to those elements that are the same as the indoor unit 1 of the second embodiment. Such elements will not be described in detail.

The upper wall 26U of the present embodiment includes a fixed upper wall 26UF and a movable upper wall 26UM. The fixed upper wall 26UF and the movable upper wall 26UM are overlapped with each other in the vertical direction (up-down direction). The movable upper wall 26UM is configured to be movable so as to slide relative to the fixed upper wall 26UF and project out of the outlet 17.

The movement mechanism 29 of the present embodiment is configured to move the movable side walls 26SM, the movable lower wall 26LM, and the movable upper wall 26UM. In one example, the movement mechanism 29 is configured to move and slide the movable side walls 26SM relative to the fixed side walls SF, move and slide the movable lower wall 26LM relative to the fixed lower wall 26LF, and move and slide the movable upper wall 26UM relative to the fixed upper wall 26UF. The movement mechanism 29 includes a first motor, a first rotation-linear movement conversion mechanism that converts rotation of the first motor into linear movement of the movable side walls 26SM, a second rotation-linear movement conversion mechanism that converts rotation of the first motor into linear movement of the movable lower wall 26LM, and a third rotation-linear movement conversion mechanism that converts rotation of the first motor into linear movement of the movable upper wall 26UM. In other words, the movement mechanism 29 of the present embodiment moves the movable side walls 26SM, the movable lower wall 26LM, and the movable upper wall 26UM with a single drive source.

Figure 7A:
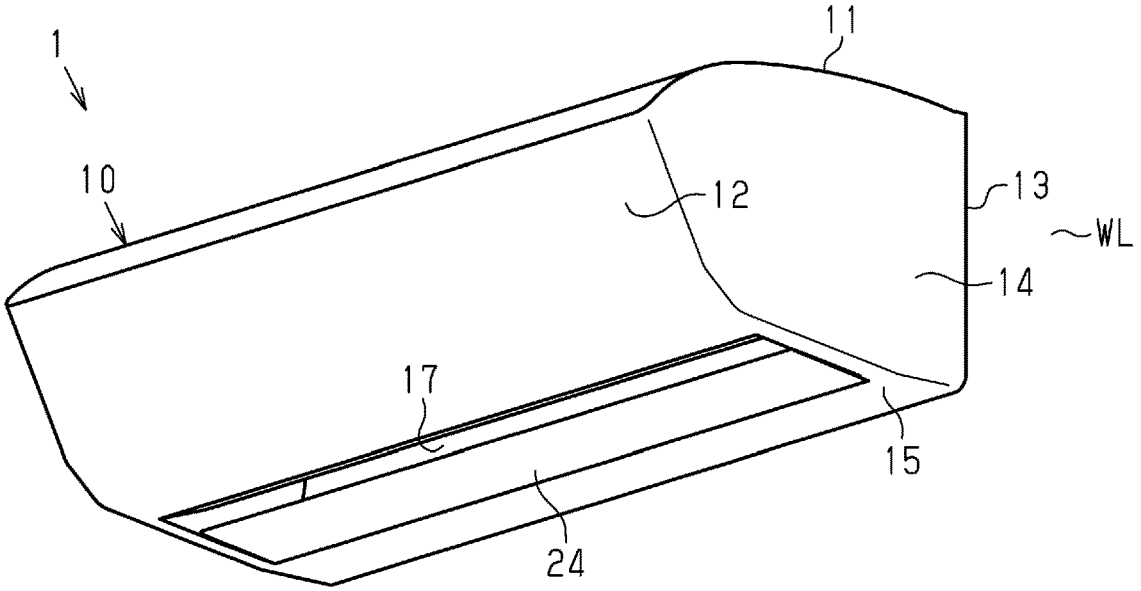
FIG. 7A is a perspective view of the indoor unit in a stored state.
Figure 7B:
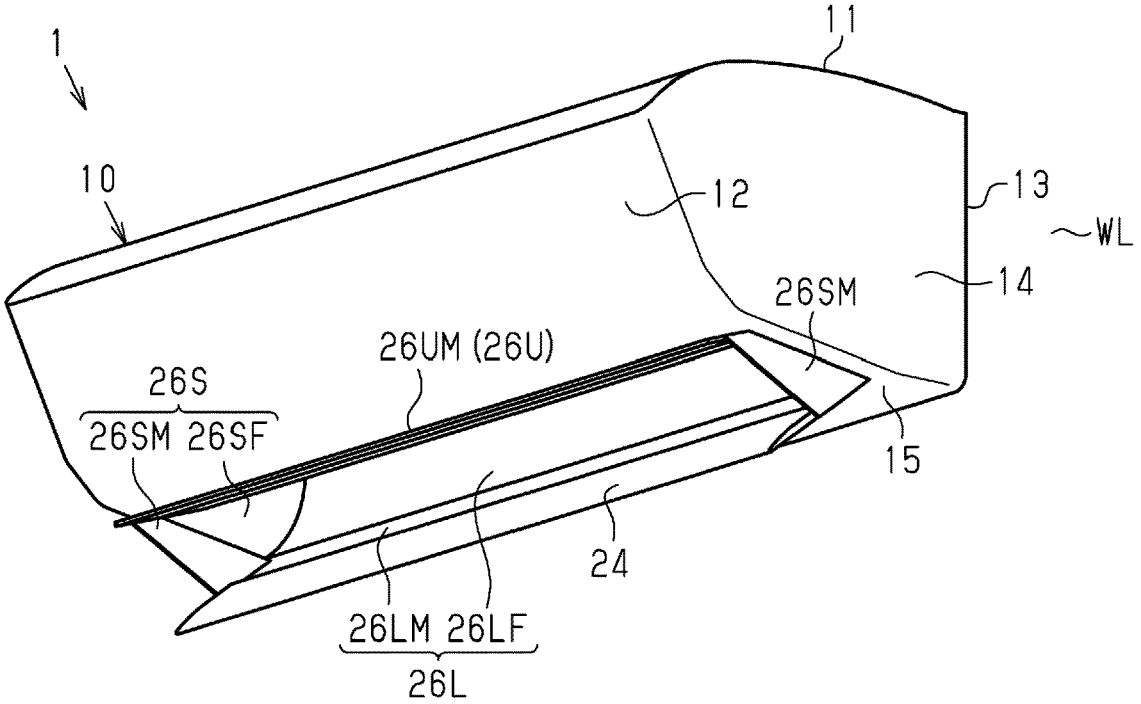
FIG. 7B is a perspective view of the indoor unit in a projected state.
Figure 8A:
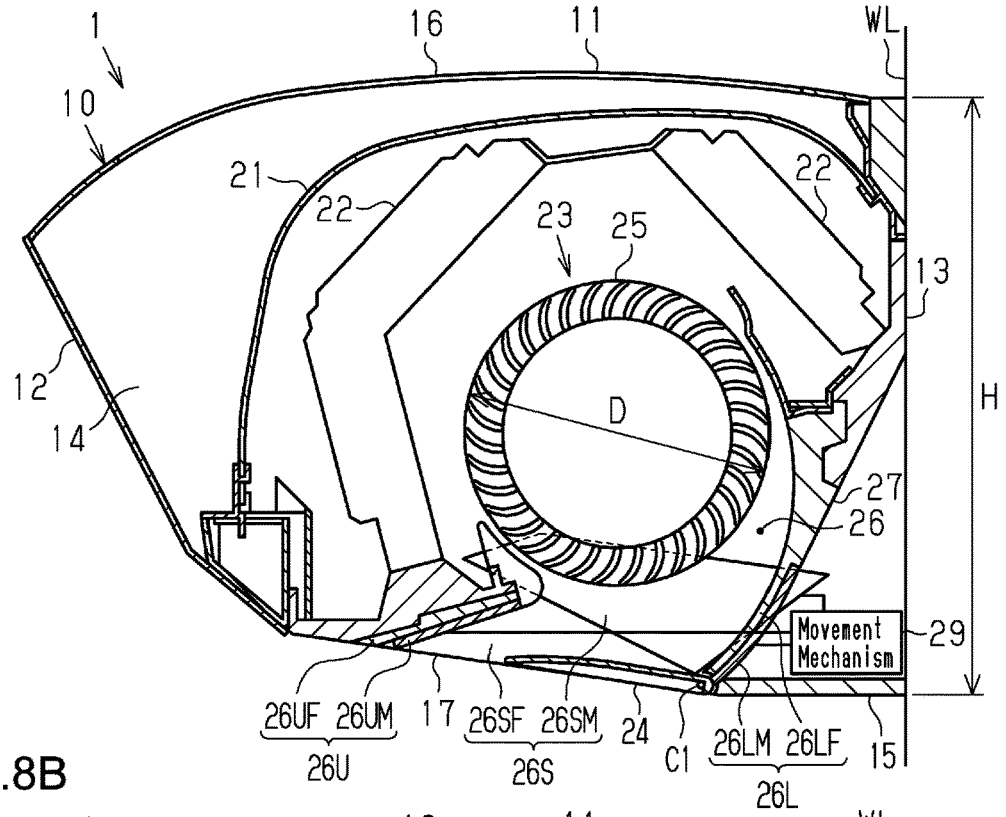
FIG. 8A is a cross-sectional view of the indoor unit in the stored state.
Figure 8B:
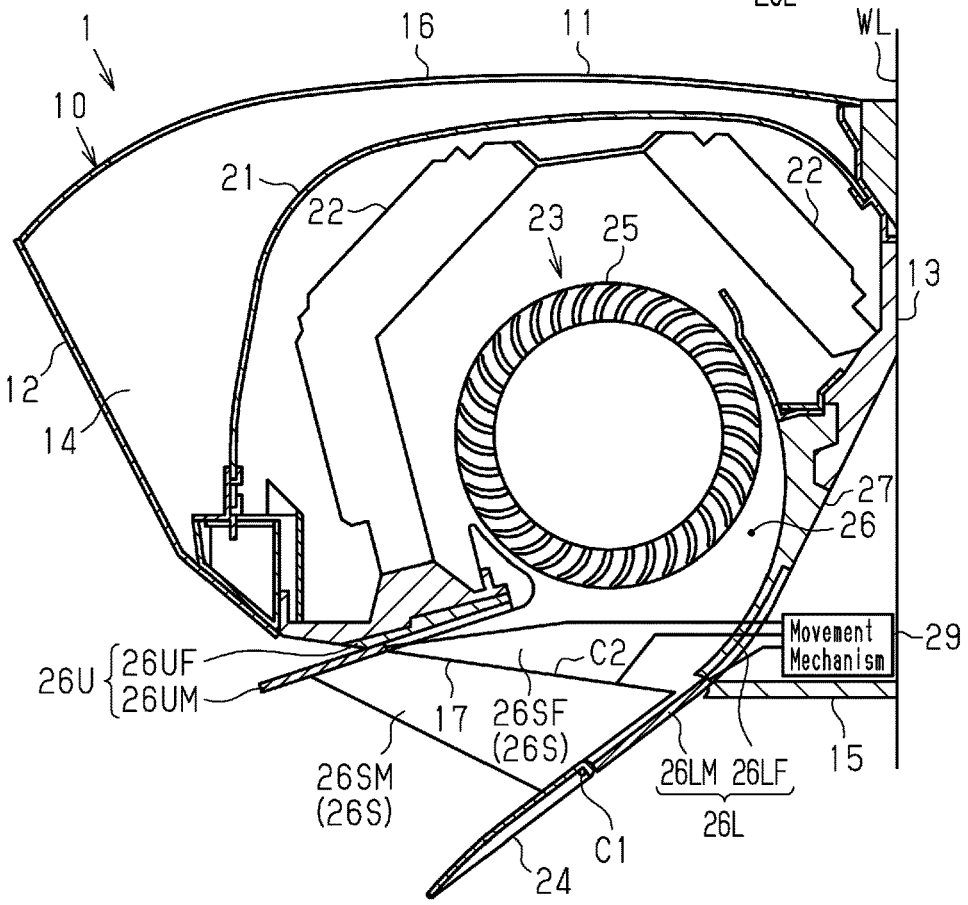
FIG. 8B is a cross-sectional view of the indoor unit in the projected state.

The indoor control unit 30 of the present embodiment (refer to FIG. 3) controls the movement mechanism 29 and switches between a stored state, in which the movable side walls 26SM, the movable lower wall 26LM, and the movable upper wall 26UM do not project out of the outlet 17 as shown in FIGS. 7A and 8A, and a projected state, in which the movable side walls 26SM, the movable lower wall 26LM, and the movable upper wall 26UM project out of the outlet 17 as shown in FIGS. 7B and 8B. In one example, the indoor control unit 30 controls the movement mechanism 29 to be in the projected state when an air conditioning operation is performed and controls the movement mechanism 29 to be in the stored state when an air conditioning operation is stopped.

In the present embodiment, as shown in FIGS. 7B and 8B, the movable side walls 26SM are configured to entirely cover vertical sides (up-down sides) of the movable lower wall 26LM and the movable upper wall 26UM in the projected state. Specifically, in the projected state, the movable side walls 26SM are located between the movable lower wall 26LM and the movable upper wall 26UM in the vertical direction and at sideward ends of the movable lower wall 26LM and the movable upper wall 26UM. The movable side walls SM are arranged so that no gap is formed between the movable side walls 26SM and the movable lower wall 26LM in the vertical direction. Further, each movable side wall 26SM is pivotal about the rotation axis C2 between the movable upper wall 26UM and the movable lower wall 26LM.

Also, the relationship of the outer diameter D of the impeller 25 of the cross-flow fan 23 and the height H of the indoor unit main body 10 of the present embodiment is the same as the relationship of the outer diameter D of the impeller 25 of the cross-flow fan 23 and the height H of the indoor unit main body 10 of the first embodiment.

The present embodiment has the following advantages in addition to the advantages of the first and second embodiments.

(3-1) The movable side walls 26SM of the two side walls 26S, the movable lower wall 26LM of the lower wall 26L, and the movable upper wall 26UM of the upper wall 26U are arranged to project out of the outlet 17 at least when an air conditioning operation is performed. This allows the blow-out flow path 26, which is surrounded by wall portions at the sideward sides and the vertical sides, to be extended from the outlet 17. In this manner, the blow-out flow path 26 serving as a diffuser is lengthened compared to a structure that does not project the two side walls 26S, the lower wall 26L, and the upper wall 26U out of the outlet 17. This further increases the static pressure in the blow-out flow path 26 and further increases the air volume of the blow-out flow path 26. Also, when the air flow resistance (internal pressure loss) in the indoor unit main body 10 is high, backflow of indoor air from the two sideward ends, the upper end, and the lower end of the outlet 17 is restricted. Thus, surging is even less likely to occur.

(3-2) The indoor unit 1 includes the movement mechanism 29 that projects the movable side walls 26SM, the movable lower wall 26LM, and the movable upper wall 26UM project out of the outlet 17 in the projected state when an air conditioning operation is performed and does not project the movable side walls 26SM, the movable lower wall 26LM, and the movable upper wall 26UM out of the outlet 17 in the stored state when an air conditioning operation is stopped. With this structure, the movable side walls 26SM, the movable lower wall 26LM, and the movable upper wall 26UM project out of the indoor unit main body 10 when an air conditioning operation is performed. Thus, surging is unlikely to occur. Further, the movable side walls 26SM, the movable lower wall 26LM, and the movable upper wall 26UM are stored in the indoor unit main body 10 when an air conditioning operation is stopped. This improves the aesthetic appearance of the indoor unit 1.

Fourth Embodiment

An indoor unit 1 of an air conditioner in accordance with a fourth embodiment will now be described with reference to FIG. 9. The indoor unit 1 of the present embodiment differs from the indoor unit 1 of the first embodiment in the structure of the cross-flow fan 23. In the description hereafter, same reference numerals are given to those elements that are the same as the indoor unit 1 of the first embodiment. Such elements will not be described in detail.

Figure 9A:
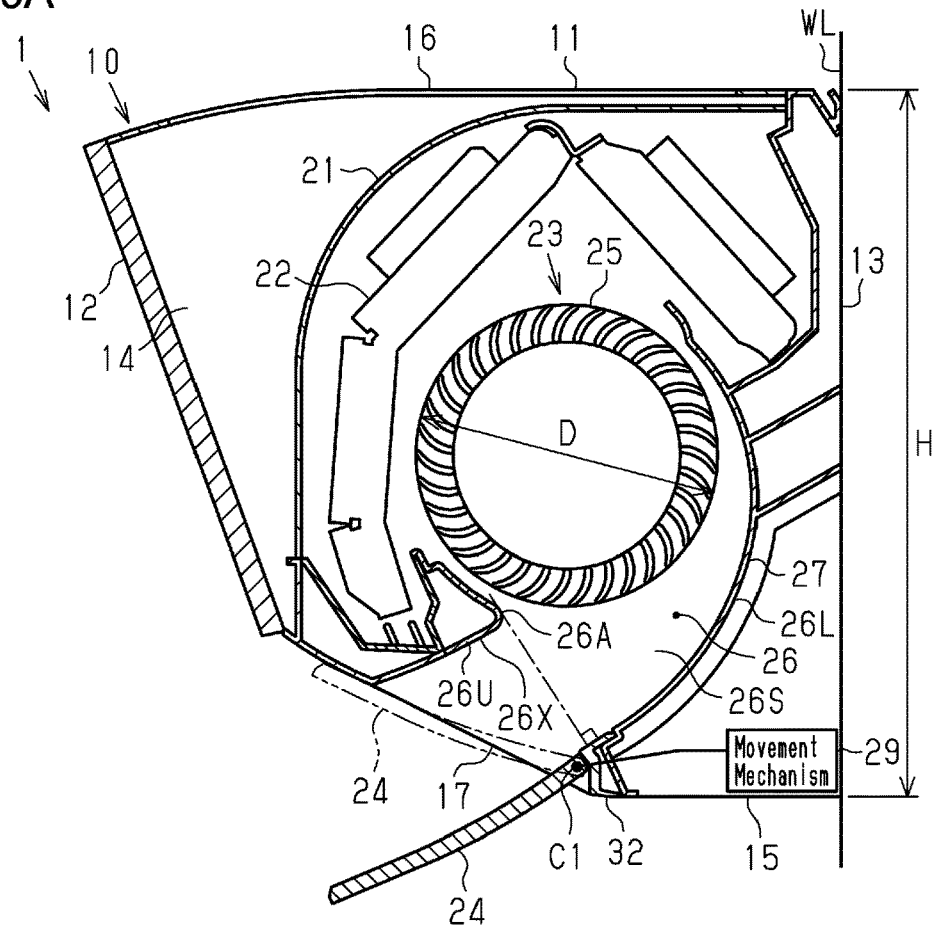
FIG. 9A is a cross-sectional view of the indoor unit.
Figure 9B:
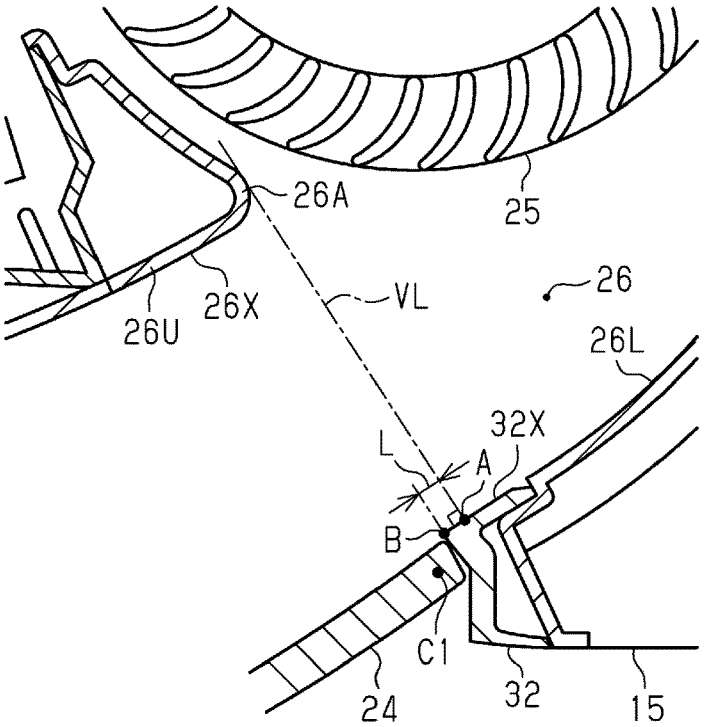
FIG. 9B is an enlarged view of a blow-out flow path and its periphery shown in FIG. 9A.

As shown in FIGS. 9A and 9B, in the indoor unit 1, the cross-flow fan 23 includes a support 32 that pivotally supports the flap 24 about the rotation axis C1. The support 32 is coupled to the lower end of the indoor unit main body 10 in the vicinity of the outlet 17. In other words, the support 32 forms the lower end of the indoor unit main body 10. The support 32 has a portion located closer to the outlet 17 to form part of the blow-out flow path 26 (lower wall 26L). The support 32 is faced toward a tongue 26A of the upper wall 26U in a direction traversing the blow-out flow path 26.

As shown in FIG. 9B, the distance between an intersection point A, which is where a tangent VL inscribing the tongue 26A of the upper wall 26U orthogonally intersects a flow path formation surface 32X of the support 32 opposing the tongue 26A, and point B, which is the lower end of the indoor unit main body 10, is referred to as distance L. Further, the outer diameter of the impeller 25 of the cross-flow fan 23 is referred to as the outer diameter D. In the present embodiment, a ratio (L/D) of the distance L to the outer diameter D is set to less than 0.05. Point B is located at the downstream-most portion of the lower wall 26L of the blow-out flow path 26. In the present embodiment, as shown in FIG. 9B, point B is the lowermost point of the flow path formation surface 32X of the support 32.

In the present embodiment, the movable side walls 26SM are omitted from the two side walls 26S. Further, in the present embodiment, the movement mechanism 29 includes the flap driving motor 28 (refer to FIG. 3). The movement mechanism 29 is configured to allow for switching between a stored state, in which the flap 24 forming the blow-out flow path 26 covers the outlet 17, and a projected state, in which the flap 24 projects out of the outlet 17. In the same manner as the first embodiment, the movement mechanism 29 is in the projected state when an air conditioning operation is performed and in the stored state when an air conditioning operation is stopped. In other words, as shown by the broken lines in FIG. 9A, the flap 24 is pivoted relative to the support 32 to cover the outlet 17 when an air conditioning operation is stopped. Further, as shown by the solid lines in FIG. 9A, the flap 24 is pivoted relative to the support 32 to open the outlet 17 when an air conditioning operation is performed. In the projected state, the flap 24 is faced toward a flow path formation surface 26X of the upper wall 26U.

The present embodiment has the following advantages.

(4-1) The flap 24 forming the lower wall of the blow-out flow path 26 is configured to project out of the outlet 17 at least when an air conditioning operation is performed. Further, the ratio (L/D) of the distance L from the tangent VL, which inscribes the tongue 26A of the cross-flow fan 23, to the point B, which is located at the lower end of the indoor unit main body 10, to the outer diameter D of the impeller 25 of the cross-flow fan 23 is less than 0.05. This limits decreases in the ease of installation of the indoor unit main body 10 and allows power consumption and noise to be reduced by increasing and the outer diameter D of the impeller 25 of the cross-flow fan 23. Also, the flap 24 projects out of the outlet 17 so that the blow-out flow path 26, or the diffuser, has a sufficient length. This maintains the functionality of the diffuser. Consequently, adverse effects on the performance of the indoor unit 1 will be limited.

(4-2) The indoor unit 1 includes the movement mechanism 29 that projects the flap 24 out of the outlet 17 in the projected state when an air conditioning operation is performed and does not project the flap 24 out of the outlet 17 in the stored state when an air conditioning operation is stopped. This projects the flap 24 out of the indoor unit main body 10 when an air conditioning operation is performed. Thus, surging is unlikely to occur. Further, the flap 24 is stored in the indoor unit main body 10 when an air conditioning operation is stopped. Thus, the aesthetic appearance of the indoor unit 1 is improved.

Modified Examples

The description related with the above embodiments exemplifies, without any intention to limit, applicable forms of an indoor unit of an air conditioner according to the present disclosure. In addition to the embodiments described above, the indoor unit of an air conditioner in accordance with the present disclosure is applicable to, for example, modified examples of the above embodiments that are described below and combinations of at least two of the modified examples that do not contradict each other. In the modified examples described hereafter, same reference numerals are given to those components that are the same as the corresponding components of the above embodiments. Such components will not be described in detail.

In the first to third embodiments, at least one of the two side walls 26S, the lower wall 26L, and the upper wall 26U of the blow-out flow path 26 may include a movable wall and a fixed wall. More specifically, the indoor unit 1 may be configured in any one of following manners (A1) to (A4).

(A1) The indoor unit 1 is configured so that each side wall 26S of the blow-out flow path 26 includes the movable side wall 26SM, the upper wall 26U includes the movable upper wall 26UM, and the lower wall 26L does not include the movable lower wall 26LM. With this structure, the movable side walls 26SM and the movable upper wall 26UM project out of the outlet 17. Thus, the movable side walls 26SM and the movable upper wall 26UM restrict the indoor air blown out of the outlet 17 from flowing sideward and upward from the outlet 17. This allows the blow-out flow path 26 to be extended from the outlet 17. In this manner, the blow-out flow path 26 serving as a diffuser is lengthened compared to a structure that does not project the two side walls 26S and the upper wall 26U out of the outlet 17. This increases the static pressure in the blow-out flow path 26 and increases the air volume of the blow-out flow path 26. Further, when the air flow resistance (internal pressure loss) in the indoor unit main body 10 is high, backflow of air from the two sideward ends and the upper part of the outlet 17 is restricted. Thus, surging is even less likely to occur.

(A2) The indoor unit 1 is configured so that the lower wall 26L of the blow-out flow path 26 includes the movable lower wall 26LM, the upper wall 26U includes the movable upper wall 26UM, and the two side walls 26S do not include the movable side walls 26SM. With this structure, the movable lower wall 26LM projects out of the outlet 17. Thus, the movable lower wall 26LM restricts the indoor air blown out of the outlet 17 from flowing downward from the outlet 17. This allows the blow-out flow path 26 to be extended from the outlet 17. In this manner, the blow-out flow path 26 serving as a diffuser is lengthened compared to a structure that does not project the lower wall 26L out of the outlet 17. This increases the static pressure in the blow-out flow path 26 and increases the air volume of the blow-out flow path 26. Further, when the air flow resistance (internal pressure loss) in the indoor unit main body 10 is high, backflow of air from the lower part of the outlet 17 is restricted. Thus, surging is even less likely to occur.

(A3) The indoor unit 1 is configured so that the lower wall 26L of the blow-out flow path 26 includes the movable lower wall 26LM, the two side walls 26S do not include the movable side walls 26SM, and the upper wall 26U does not include the movable upper wall 26UM. With this structure, the movable lower wall 26LM projects out of the outlet 17. Thus, the movable lower wall 26LM restricts the indoor air blown out of the outlet 17 from flowing downward from the outlet 17. This allows the blow-out flow path 26 to be extended from the outlet 17. In this manner, the blow-out flow path 26 serving as a diffuser is lengthened compared to a structure that does not project the lower wall 26L out of the outlet 17. This increases the static pressure in the blow-out flow path 26 and increases the air volume of the blow-out flow path 26. Further, when the air flow resistance (internal pressure loss) in the indoor unit main body 10 is high, backflow of air from the lower part of the outlet 17 is restricted. Thus, surging is even less likely to occur.

(A4) The indoor unit 1 is configured so that the upper wall 26U of the blow-out flow path 26 includes the movable upper wall 26UM, the two side walls 26S do not include the movable side walls 26SM, and the lower wall 26L does not include the movable lower wall 26LM. With this structure, the movable upper wall 26UM projects out of the outlet 17. Thus, movable upper wall 26UM restricts the indoor air blown out of the outlet 17 from flowing upward from the outlet 17. This allows the blow-out flow path 26 to be extended from the outlet 17. In this manner, the blow-out flow path 26 serving as a diffuser is lengthened compared to a structure that does not project the upper wall 26U out of the outlet 17. This increases the static pressure in the blow-out flow path 26 and increases the air volume of the blow-out flow path 26. Further, when the air flow resistance (internal pressure loss) in the indoor unit main body 10 is high, backflow of air from the upper part of the outlet 17 is restricted. Thus, surging is even less likely to occur.

In the above-described first to third embodiments, the two side walls 26S may be changed to have following configurations in (B1) to (B3).

Figure 10A:
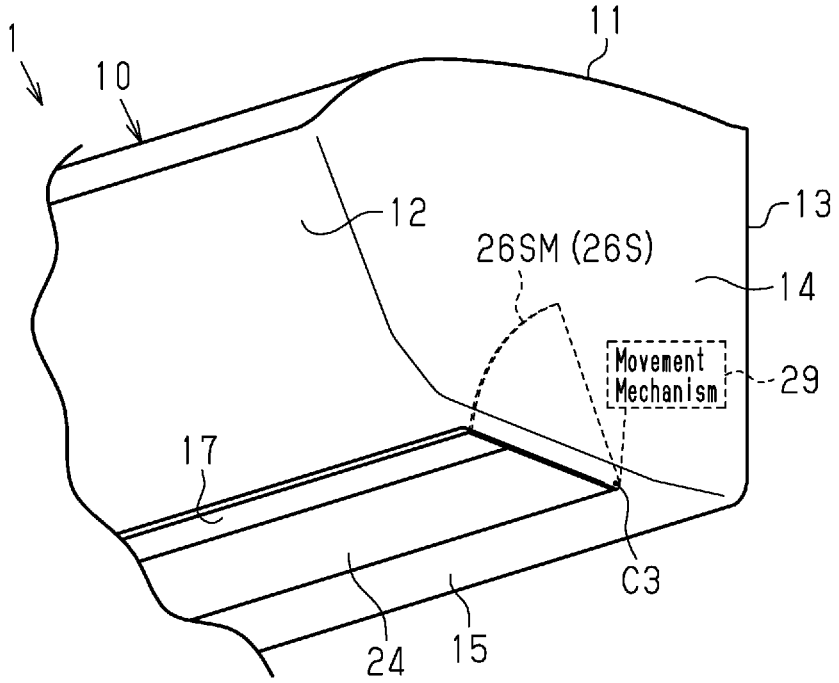
FIG. 10A is a perspective view of the indoor unit in a stored state.
Figure 10B:
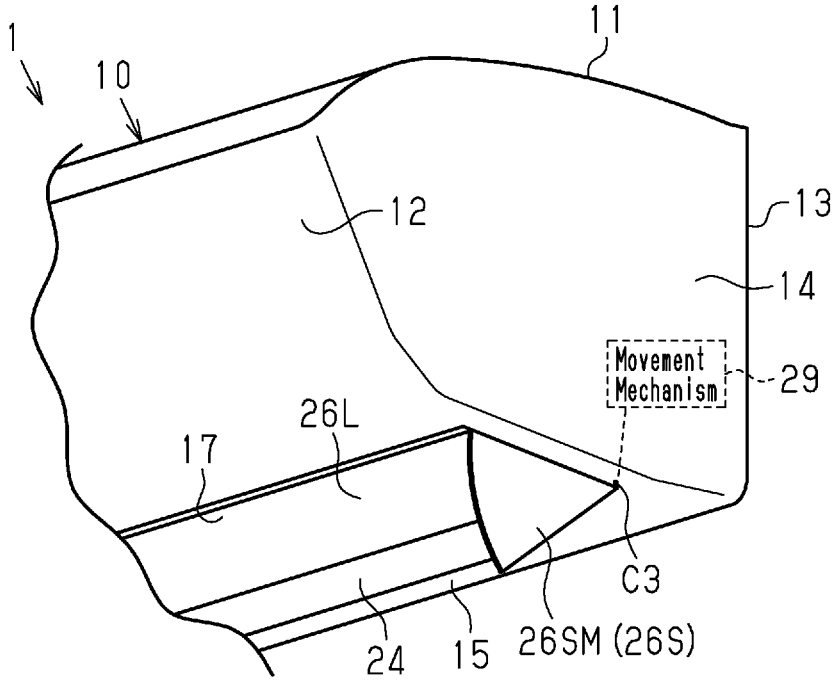
FIG. 10B is a perspective view of the indoor unit in a projected state.

(B1) As shown in FIGS. 10A and 10B, the two side walls 26S each include the movable side wall 26SM that is sectoral and extends about rotation axis C3. The movement mechanism 29 includes a driving motor that rotates the movable side walls 26SM about the rotation axis C3. An output shaft of the driving motor may be directly connected to the movable side walls 26SM. Alternatively, the output shaft of the driving motor may be connected to the movable side walls 26SM by a decelerator. The movement mechanism 29 moves and switches the movable side walls 26SM between a stored state shown in FIG. 10A and a projected state shown in FIG. 10B. As shown in FIG. 10A, in the stored state, the movable side walls 26SM are stored in the indoor unit main body 10, that is, the movable side walls 26SM do not project out of the outlet 17. As shown in FIG. 10B, in the projected state, the movable side walls 26SM are in a state projected out of the indoor unit main body 10, that is, the movable side walls 26SM project out of the outlet 17. The movable side walls 26SM shown in FIGS. 10A and 10B are arranged next to lateral (sideward) end surfaces of the flap 24. Preferably, no gap is formed between the movable side walls 26SM and the sideward end surfaces of the flap 24.

Figure 11A:
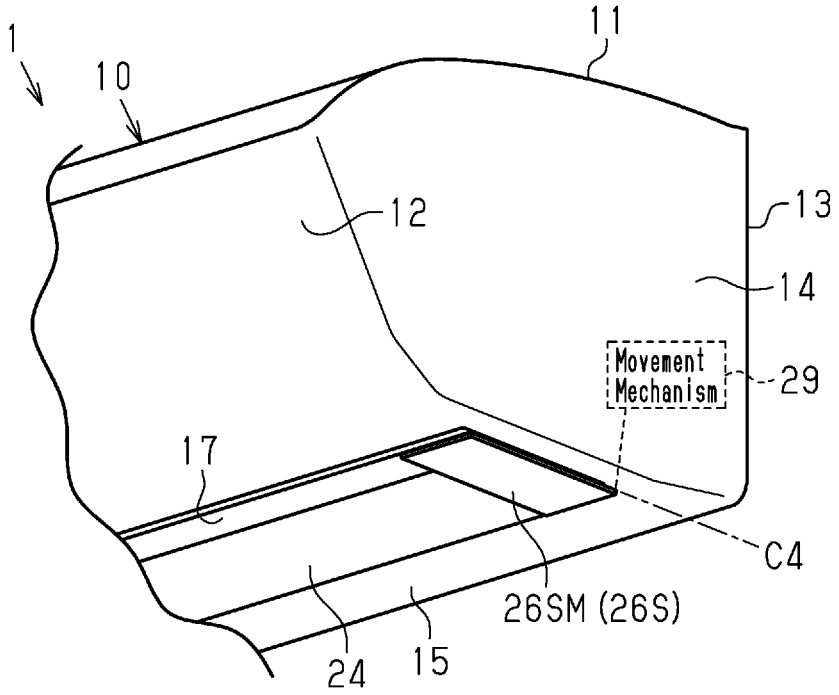
FIG. 11A is a perspective view of the indoor unit in a stored state.
Figure 11B:
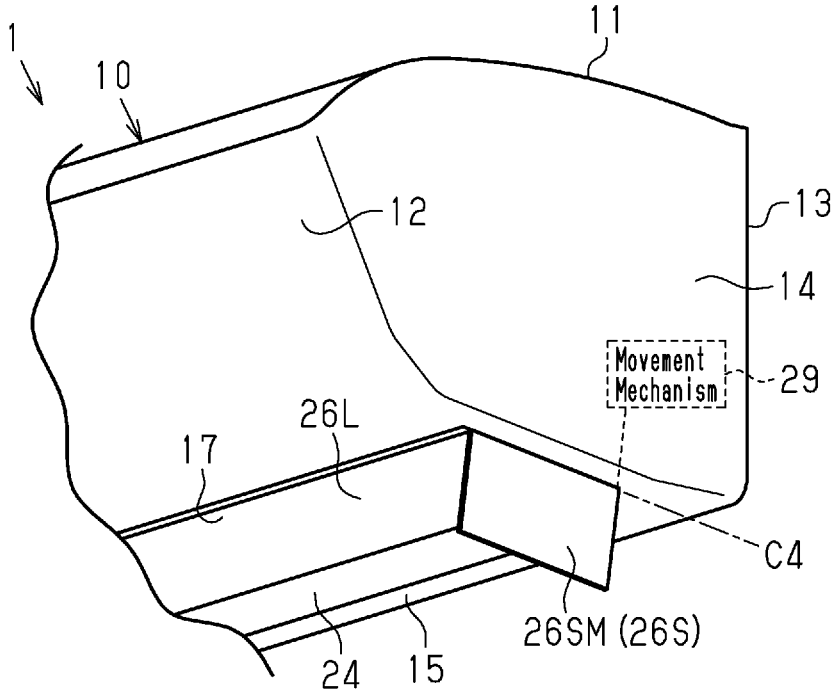
FIG. 11B is a perspective view of the indoor unit in a projected state.

(B2) As shown in FIGS. 11A and 11B, the two side walls 26S each include the movable side wall 26SM that is rotated about a rotation axis C4. The movement mechanism 29 includes a driving motor that rotates the movable side walls 26SM about the rotation axis C4. The output shaft of the driving motor may be directly connected to the movable side walls 26SM. Alternatively, the output shaft of the driving motor may be connected to the movable side walls 26SM by a decelerator. The movement mechanism 29 moves and switches the movable side walls 26SM between a stored state shown in FIG. 11A and a projected state shown in FIG. 11B. As shown in FIG. 11A, in the stored state, the movable side walls 26SM cover the lateral (sideward) ends of the outlet 17, that is, the movable side walls 26SM do not project out of the outlet 17. In the stored state, the flap 24 is moved by the flap driving motor 28 (refer to FIG. 3) to cover the outlet 17. In the stored state, the movable side walls 26SM are rotated to cover the lateral (sideward) ends of the flap 24. As shown in FIG. 11B, in the projected state, the movable side walls 26SM are in a state projected out of the indoor unit main body 10, that is the movable side walls 26SM project out of the outlet 17. In one example, when the stored state is changed to the projected state, the movable side walls 26SM are pivoted and moved to an outer side of the flap 24 in the lateral direction (sideward direction). Then, the flap 24 is pivoted to project out of the outlet 17.

Figure 12A:
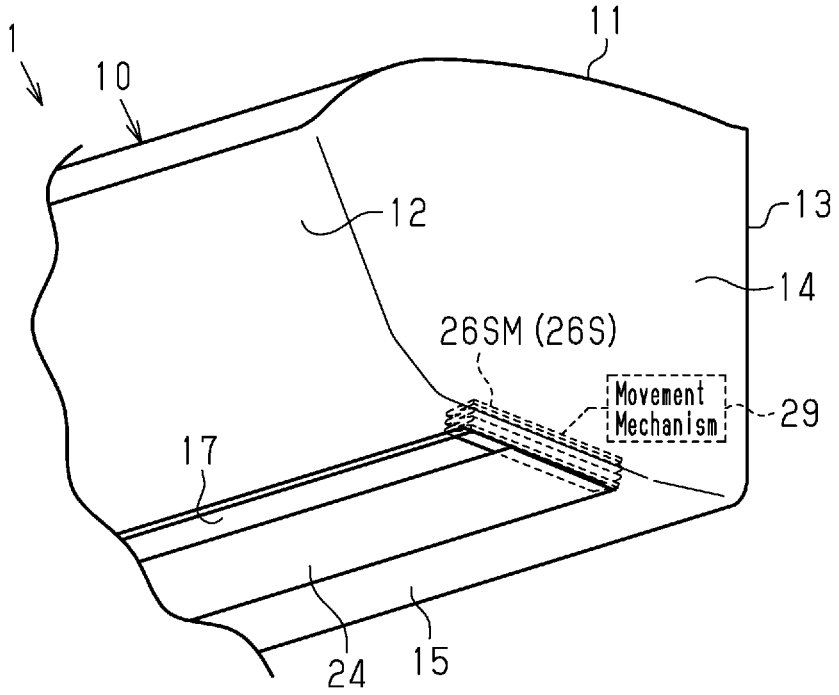
FIG. 12A is a perspective view of the indoor unit in a stored state.
Figure 12B:
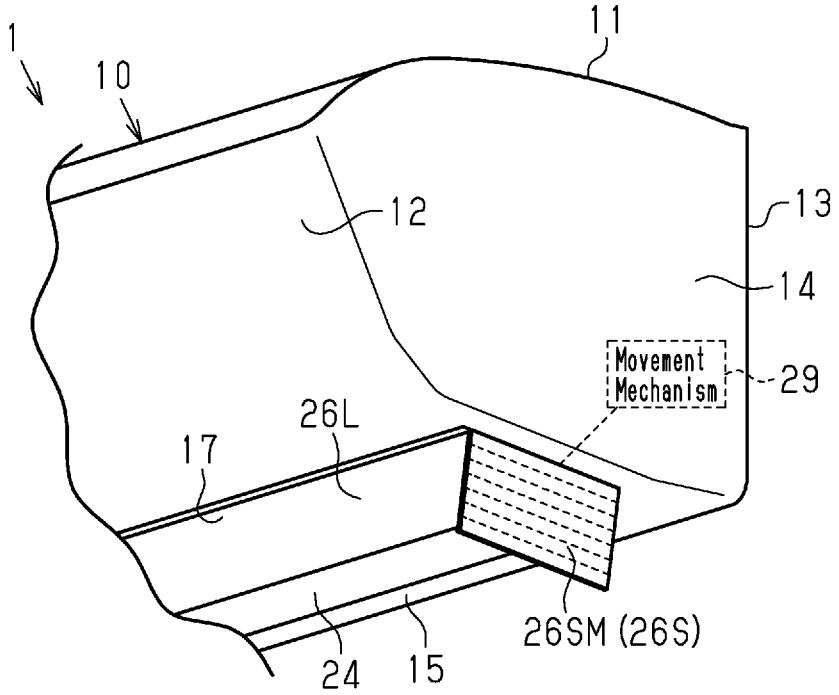
FIG. 12B is a perspective view of the indoor unit in a projected state.

(B3) As shown in FIGS. 12A and 12B, the two side walls 26S each include the movable side wall 26SM that is expandable. The movable side wall 26SM has an accordion structure. The movement mechanism 29 includes a motor that serves as a drive source and a rotation-linear movement conversion mechanism that converts rotation of the motor into linear movement of the movable side walls 26SM in an expanding direction. The movement mechanism 29 moves and switches the movable side walls 26SM between a stored state shown in FIG. 12A and a projected state shown in FIG. 12B. As shown in FIG. 12A, in the stored state, the movable side walls 26SM are retracted to be stored in the indoor unit main body 10, that is, the movable side walls 26SM do not project out of the outlet 17. As shown in FIG. 12B, in the projected state, the movable side walls SM are expanded to project out of the indoor unit main body 10, that is, the movable side walls SM are in a state projected out of the outlet 17. The movable side walls 26SM in FIGS. 12A and 12B are arranged adjacent to the flap 24 in the lateral direction (sideward direction). Preferably, no gap is formed between the movable side walls 26SM and the sideward end surfaces of the flap 24.

In the first to third embodiments, the movable side walls 26SM do not have to be configured to be rotated about the rotation axis C2. In this case, the movable side walls 26SM may be configured so that the distance between the movable side walls 26SM in the sideward direction decreases toward the downstream side in the blow-out flow path 26.

Figure 13A:
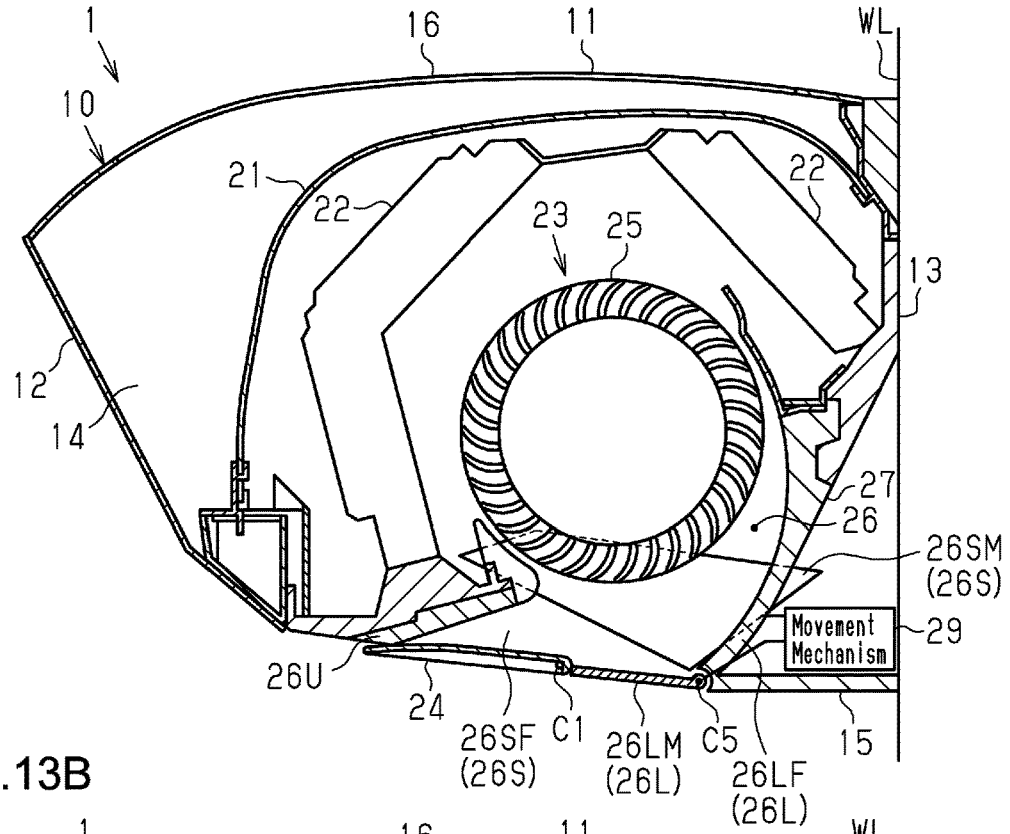
FIG. 13A is a cross-sectional view of the indoor unit in a stored state.
Figure 13B:
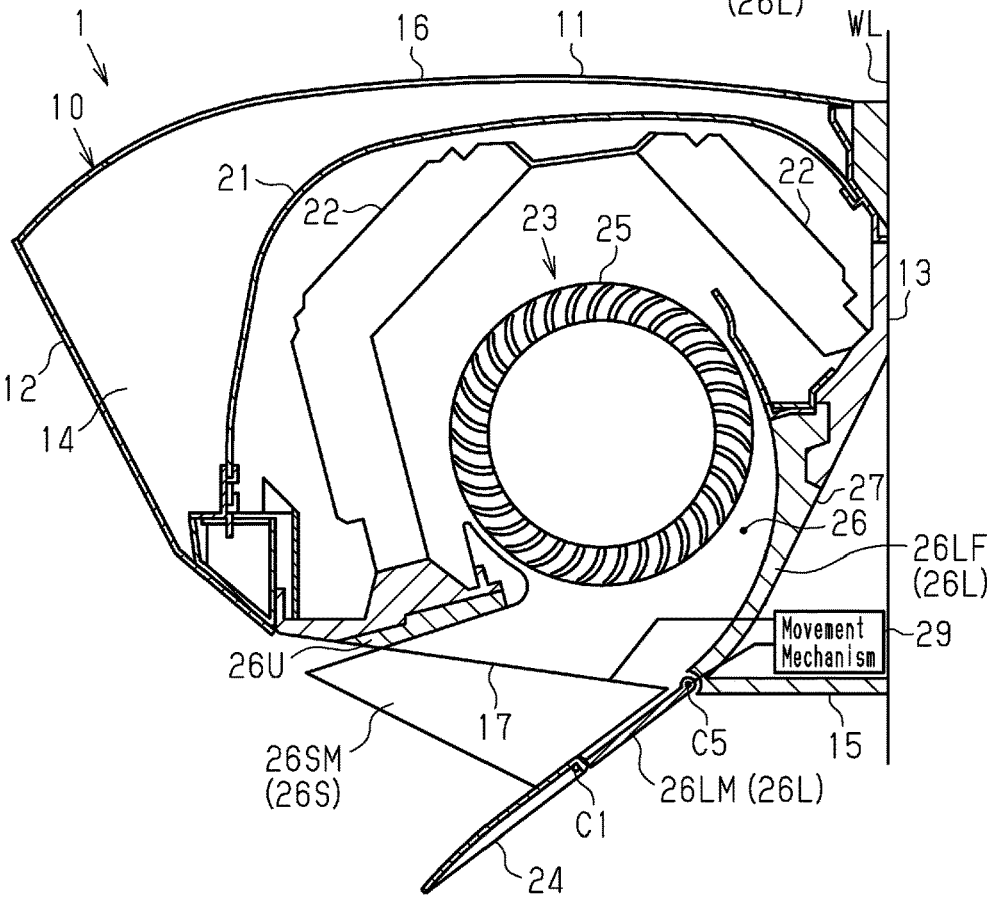
FIG. 13B is a cross-sectional view of the indoor unit in a projected state.

In the second and third embodiments, as shown in FIGS. 13A and 13B, the movable lower wall 26LM of the lower wall 26L arranged at the distal end of the fixed lower wall 26LF, which is the lower end of the indoor unit main body 10, may be pivotal about a rotation axis C5. The flap 24 is pivotally arranged at the distal end of the movable lower wall 26LM. As shown in FIG. 13A, when an air conditioning operation is stopped, the movement mechanism 29 pivots the movable lower wall 26LM to cover the outlet 17 in the stored state. In this case, the outlet 17 is covered by the movable lower wall 26LM and the flap 24. As shown in FIG. 13B, when an air conditioning operation is performed, the movement mechanism 29 pivots and projects the movable lower wall 26LM out of the outlet 17 in the projected state. In this case, the outlet 17 is not covered by the movable lower wall 26LM or the flap 24. In the projected state, the flap driving motor 28 (refer to FIG. 3) may freely change a pivotal position of the flap 24 relative to the movable lower wall 26LM.

Figure 14A:
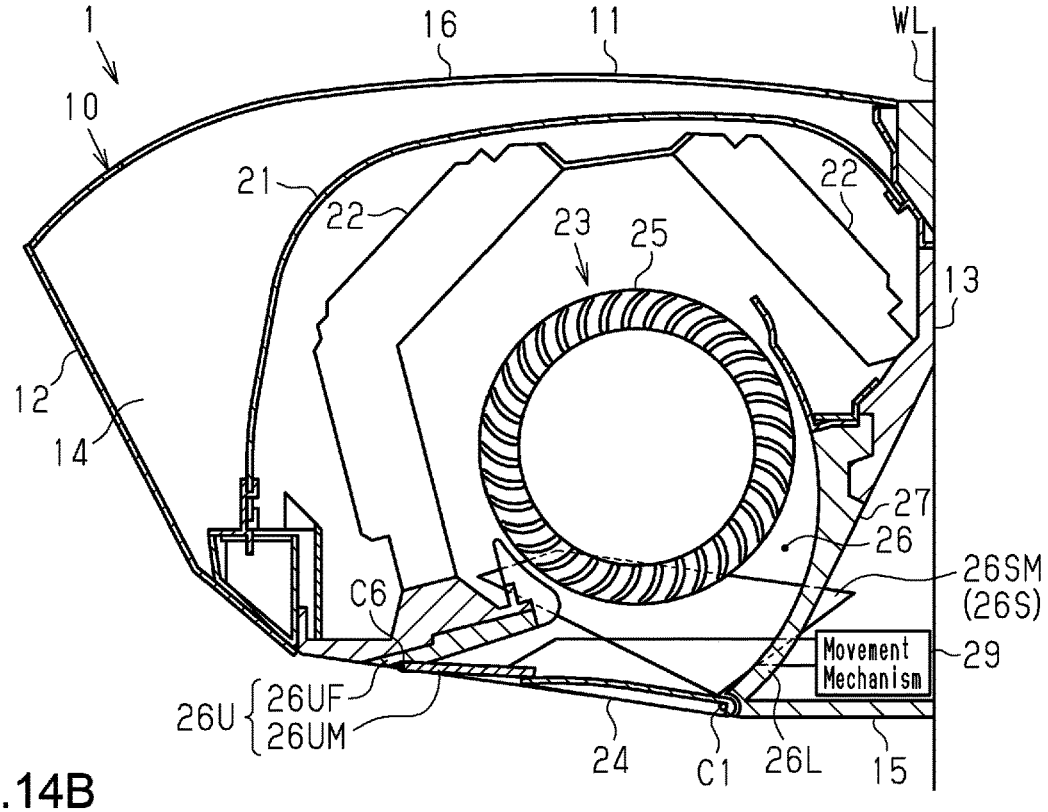
FIG. 14A is a cross-sectional view of the indoor unit in a stored state.
Figure 14B:
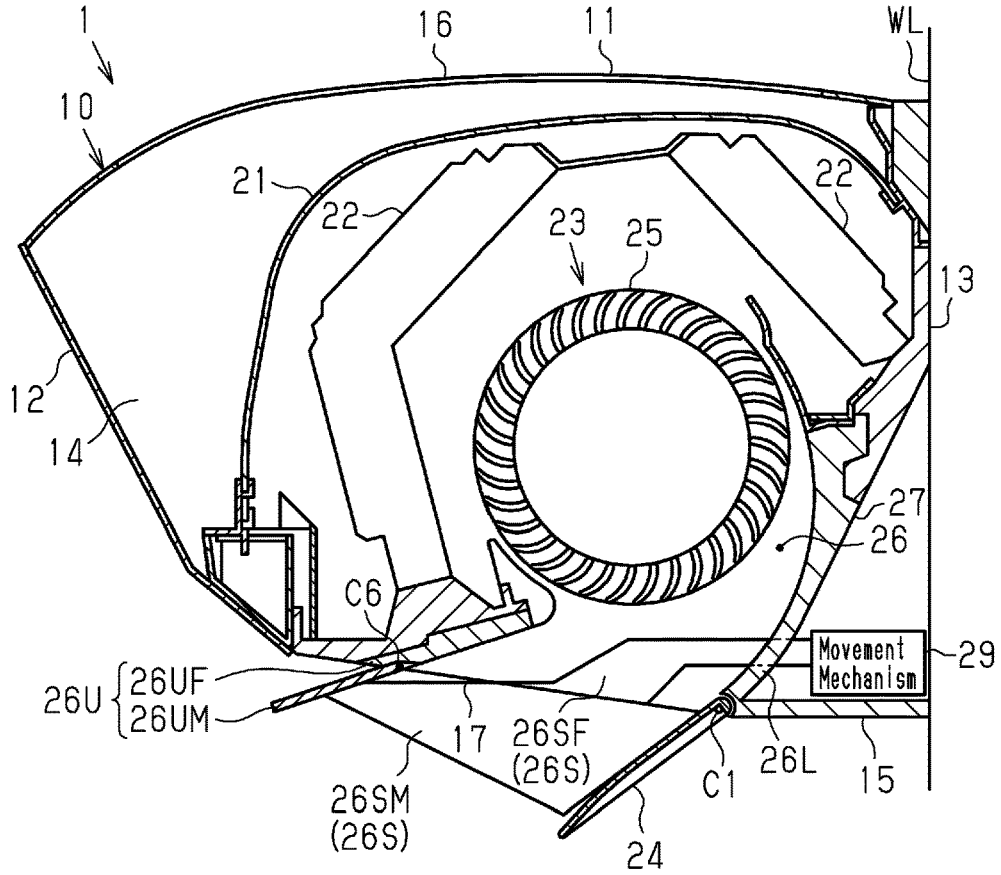
FIG. 14B is a cross-sectional view of the indoor unit in a projected state.

In the third embodiment, as shown in FIGS. 14A and 14B, the movable upper wall 26UM of the upper wall 26U arranged at the distal end of the fixed upper wall 26UF may be rotatable about a rotation axis C6. As shown in FIG. 14A, when an air conditioning operation is stopped, the movement mechanism 29 pivots the movable upper wall 26UM to cover the outlet 17 in the stored state. When an air conditioning operation is stopped, the flap driving motor 28 (refer to FIG. 3) moves the flap 24 so that the flap 24 also covers the outlet 17. In this manner, the movable upper wall 26UM and the flap 24 entirely cover the outlet 17. As shown in FIG. 14B, when an air conditioning operation is performed, the movement mechanism 29 pivots and projects the movable upper wall 26UM out of the outlet 17 in the projected state. In this case, the outlet 17 is not covered by the movable upper wall 26UM or the flap 24.

In the second embodiment, the movement mechanism 29 may include a first movement mechanism that moves the movable side walls 26SM and a second movement mechanism that moves the movable lower wall 26LM. The first movement mechanism and the second movement mechanism each include a motor and a rotation-linear movement conversion mechanism that converts rotation of the corresponding motor into linear movement. This allows the movable side walls 26SM to be controlled separately from the movable lower wall 26LM.

In the second and third embodiments, when surging occurs, the movement mechanism 29 may rotate the flap 24 to decrease the cross-sectional area of the blow-out flow path 26 at a downstream side of the outlet 17.

In the third embodiment, the movement mechanism 29 may include a first movement mechanism that moves the movable side walls 26SM, a second movement mechanism that moves the movable lower wall 26LM, and a third movement mechanism that moves the movable upper wall 26UM. The first to third movement mechanisms each include a motor and a rotation-linear movement conversion mechanism that converts rotation of the corresponding motor into linear movement. This allows for separate control of the movable side walls 26SM, the movable lower wall 26LM, and the movable upper wall 26UM.

In the third embodiment, the movement mechanism 29 may include a first movement mechanism that moves the movable side walls 26SM and the movable lower wall 26LM and a second movement mechanism that moves the movable upper wall 26UM. The first and second movement mechanisms each include a motor and a rotation-linear movement conversion mechanism that converts rotation of the corresponding motor into linear movement. This allows the movable side walls 26SM and the movable lower wall 26LM to be controlled separately from the movable upper wall 26UM.

In third embodiment, the movement mechanism 29 may include a first movement mechanism that moves the movable side walls 26SM and a second movement mechanism that moves the movable lower wall 26LM and the movable upper wall 26UM. The first and second movement mechanisms each include a motor and a rotation-linear movement conversion mechanism that converts rotation of the corresponding motor into linear movement. This allows the movable side walls 26SM to be controlled separately from the movable lower wall 26LM and the movable upper wall 26UM.

In the third embodiment, the movement mechanism 29 may include a first movement mechanism that moves the movable side walls 26SM and the movable upper wall 26UM and a second movement mechanism that moves the movable lower wall 26LM. The first and second movement mechanisms each include a motor and a rotation-linear movement conversion mechanism that converts rotation of the corresponding motor into linear movement. This allows the movable side walls 26SM and the movable upper wall 26UM to be controlled separately from the movable lower wall 26LM.

In the third embodiment, the blow-out flow path 26 may be formed to project out of the outlet 17 so that the cross-sectional area of the blow-out flow path 26 at a downstream side of the outlet 17 is smaller than the cross-sectional area of the outlet 17. In one example, at least one of the movable side walls 26SM, the movable lower wall 26LM, and the movable upper wall 26UM is moved by the movement mechanism 29 so that the cross-sectional area surrounded by the movable side walls 26SM, the movable lower wall 26LM, and the movable upper wall 26UM, which are elements of the blow-out flow path 26, is smaller than the cross-sectional area of the outlet 17. This increases the velocity in the blow-out flow path 26 at a downstream side and restricts backflow of indoor air from the outlet 17. Thus, surging is even less likely to occur.

In the fourth embodiment, the indoor unit 1 may be changed in any one of following manners (C1) to (C4).

(C1) The indoor unit 1 further includes the movable side walls 26SM and the movement mechanism 29 that moves the movable side walls 26SM. In one example, the movable side walls 26SM and the movement mechanism 29 have the same structure as the movable side walls 26SM and the movement mechanism 29 of the first embodiment. With this structure, the movable side walls 26SM project out of the outlet 17. Thus, the movable side walls 26SM and the movable upper wall 26UM restrict the indoor air blown out of the outlet 17 from flowing sideward from the outlet 17. This allows the blow-out flow path 26 to be extended from the outlet 17. In this manner, the blow-out flow path 26 is lengthened compared to a structure that does not project the two side walls 26S and the upper wall 26U out of the outlet 17. This increases the static pressure in the blow-out flow path 26 and increases the air volume of the blow-out flow path 26. Further, when the air flow resistance (internal pressure loss) in the indoor unit main body 10 is high, backflow of air from the two sideward ends of the outlet 17 is restricted. Thus, surging is even less likely to occur.

(C2) The indoor unit 1 further includes the movable lower wall 26LM and the movement mechanism 29 that moves the movable lower wall 26LM. In one example, the movable lower wall 26LM and the movement mechanism 29 have the same structure as the movable lower wall 26LM and the movement mechanism 29 of the second embodiment. In this case, the flap 24 is rotatably arranged at the distal end of the movable lower wall 26LM. With this structure, the movable lower wall 26LM projects out of the outlet 17. Thus, the movable lower wall 26LM restricts the indoor air blown out of the outlet 17 from flowing downward from the outlet 17. This allows the blow-out flow path 26 to be extended from the outlet 17. In this manner, the blow-out flow path 26 serving as a diffuser is lengthened compared to a structure that does not project the lower wall 26L out of the outlet 17. This increases the static pressure in the blow-out flow path 26 and increases the air volume of the blow-out flow path 26. Further, when the air flow resistance (internal pressure loss) in the indoor unit main body 10 is high, backflow of air from the lower part of the outlet 17 is restricted. Thus, surging is even less likely to occur.

(C3) The indoor unit 1 further includes the movable upper wall 26UM and the movement mechanism 29 that moves the movable upper wall 26UM. In one example, the movable upper wall 26UM and the movement mechanism 29 have the same structure as the movable upper wall 26UM and the movement mechanism 29 of the third embodiment. With this structure, the movable upper wall 26UM projects out of the outlet 17 and thus the movable upper wall 26UM restricts the indoor air blown out of the outlet 17 from flowing upward from the outlet 17. This allows the blow-out flow path 26 to be extended from the outlet 17. In this manner, the blow-out flow path 26, which functions as a diffuser, is lengthened compared to a structure that does not project the upper wall 26U out of the outlet 17. This increases the static pressure in the blow-out flow path 26 and increases the air volume of the blow-out flow path 26. Further, when the air flow resistance (internal pressure loss) in the indoor unit main body 10 is high, backflow of air from the upper part of the outlet 17 is restricted. Thus, surging is even less likely to occur.

(C4) The indoor unit 1 further includes at least one of the movable side walls 26SM, the movable lower wall 26LM, and the movable upper wall 26UM and the movement mechanism 29 that moves at least one of the movable side walls 26SM, the movable lower wall 26LM, and the movable upper wall 26UM. This structure has an advantage of at least one of the above-described modified examples (C1) to (C3).

Figure 15A:
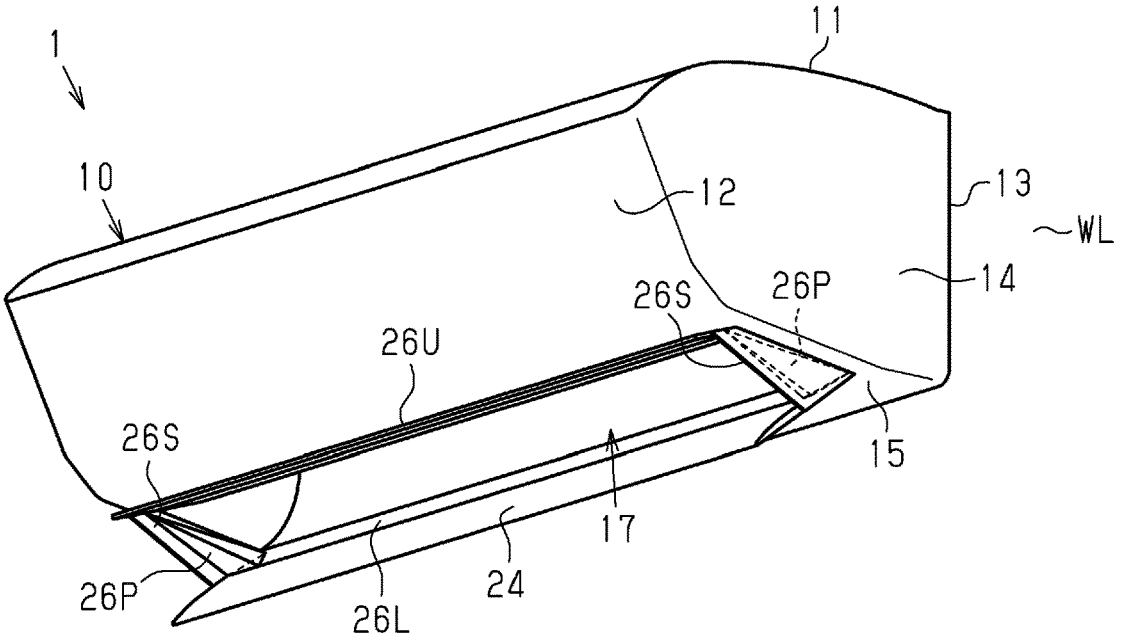
FIG. 15A is a perspective view of the indoor unit.
Figure 15B:
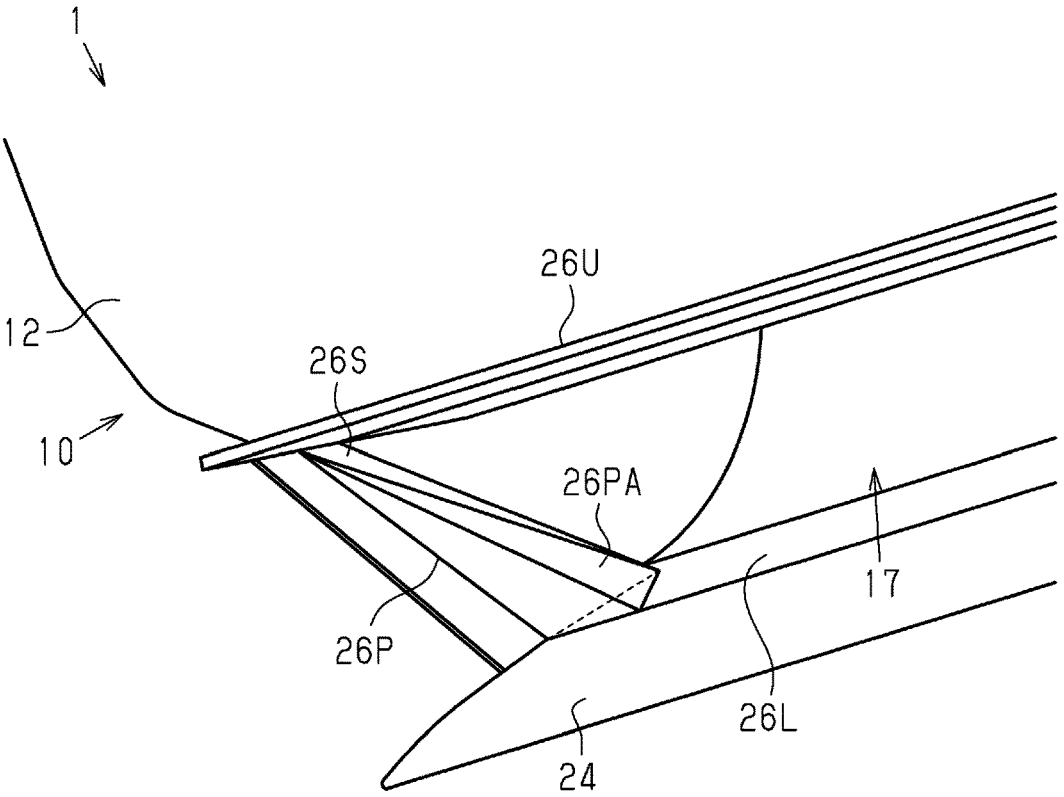
FIG. 15B is an enlarged view of part of FIG. 15A.

In the first to fourth embodiments, the movement mechanism 29 may be omitted. In this case, the elements of the blow-out flow path 26 are constantly in the projected state. In other words, at least one of the two side walls 26S, the upper wall 26U, and the lower wall 26L is arranged to project out of the outlet 17. In one example, in the indoor unit 1 shown in FIGS. 15A and 15B, the two side walls 26S, the upper wall 26U, and the lower wall 26L, which are the elements of the blow-out flow path 26, are arranged to project out of the outlet 17. In this case, for example, a projection 26P may be arranged on each side wall 26S at a downstream side of the outlet 17 so that the distance between the two side walls 26S in the sideward direction at a downstream side of the outlet 17 in the blow-out flow path 26 is less than the sideward length of the outlet 17. In one example, as shown in FIGS. 15A and 15B, each projection 26P has the form of a substantially three-sided pyramid such that the distance between the two side walls 26S (distance between projections 26P in sideward direction) decreases from the upper wall 26U toward the lower wall 26L. Further, the projections 26P include surfaces 26PA opposed toward each other in the sideward direction. The surfaces 26PA are formed so that the distance between the projections 26P in the sideward direction decreases toward a downstream side in the blow-out flow path 26. The projection 26P may have any shape as long as the distance between the two side walls 26S in the blow-out flow path 26 at a downstream side of the outlet 17 is less than the sideward length of the outlet 17.

In the first to third embodiments, the projections 26P may be arranged so that the distance between the two side walls 26S in the sideward direction at a downstream side in the blow-out flow path 26, which is extended by the two side walls 26S projected out of the outlet 17, is constantly smaller than the distance between the two side walls 26S in the sideward direction in the blow-out flow path 26 at the side of the outlet 17 (upstream side). Thus, the velocity in the blow-out flow path 26 at a downstream side is increased. This restricts backflow of indoor air from the outlet 17 and thus surging is even less likely to occur.

It should be understood that the above-described disclosure of the indoor unit of an air conditioner may be embodied in many other specific forms within the scope and equivalence of the present disclosure described in the appended claims.

The invention claimed is:

1. An indoor unit of an air conditioner, comprising:

an indoor unit main body including an inlet and an outlet;

a heat exchanger that performs heat exchange on air drawn in from the inlet; and a cross-flow fan configured to blow out air, which has undergone heat exchange performed by the heat exchanger, from the outlet, wherein the cross-flow fan includes a blow-out flow path formed by a lower wall, left and right side walls, and an upper wall so that a cross-sectional area gradually increases downward, with the blow-out flow path guiding blown-out air to the outlet, when a distance in the lower wall from an intersection, where a tangent inscribing a tongue formed on a flow path formation surface of the upper wall of the cross-flow fan orthogonally intersects the lower wall, to a lower end of the indoor unit main body is referred to as distance L, a ratio (L/D) of the distance L to an outer diameter D of an impeller of the cross-flow fan is less than 0.05, at least part of the blow-out flow path is formed to project out of the outlet at least when an air conditioning operation is performed, and the two side walls are arranged to project out of the outlet independently from the upper wall and the lower wall at least when an air conditioning operation is performed.

2. The indoor unit of an air conditioner according to claim 1, wherein the lower wall is arranged to project out of the outlet at least when an air conditioning operation is performed.

3. The indoor unit of an air conditioner according to claim 1, wherein the upper wall is arranged to project out of the outlet at least when an air conditioning operation is performed.

4. The indoor unit of an air conditioner according to claim 1, wherein a ratio (H/D) of height H of the indoor unit main body to the outer diameter D of the impeller of the cross-flow fan is less than 2.2.

5. The indoor unit of an air conditioner according to claim 1, further comprising:

a movement mechanism configured to switch between a stored state that does not project the blow-out flow path out of the outlet and a projected state that projects at least part of the blow-out flow path out of the outlet, wherein the movement mechanism is set in the projected state when an air conditioning operation is performed, and the movement mechanism is set in the stored state when an air conditioning operation is stopped.

* * * * *